US008259036B2

(12) United States Patent
Ryu et al.

(10) Patent No.: US 8,259,036 B2
(45) Date of Patent: Sep. 4, 2012

(54) PLASMA DISPLAY APPARATUS

(75) Inventors: Seongnam Ryu, Gumi (KR); Woogon Jeon, Gumi (KR); Wootae Kim, Gumi (KR); Kyunga Kang, Gumi (KR); Jeonghyun Hamh, Gumi (KR); Jaesung Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 1103 days.

(21) Appl. No.: 11/923,122

(22) Filed: Oct. 24, 2007

(65) Prior Publication Data

US 2008/0100536 A1 May 1, 2008

(30) Foreign Application Priority Data

Oct. 25, 2006 (KR) ..... 10-2006-0103946

(51) Int. Cl.
*G09G 3/28* (2006.01)

(52) U.S. Cl. ..... 345/60

(58) Field of Classification Search ..... 345/37, 345/60

See application file for complete search history.

(56) References Cited

U.S. PATENT DOCUMENTS

| | | | | |
|---|---|---|---|---|
| 2003/0156080 | A1* | 8/2003 | Koike et al. | 345/60 |
| 2005/0029941 | A1 | 2/2005 | Kwon et al. | 313/582 |
| 2005/0180145 | A1* | 8/2005 | Okuwaki | 362/336 |
| 2005/0253493 | A1* | 11/2005 | Park et al. | 313/110 |
| 2006/0154092 | A1* | 7/2006 | Naito et al. | 428/457 |
| 2006/0158116 | A1* | 7/2006 | Kwon et al. | 313/582 |
| 2006/0176569 | A1* | 8/2006 | Yoshida et al. | 359/626 |
| 2006/0244678 | A1* | 11/2006 | Cha | 345/37 |
| 2006/0244685 | A1* | 11/2006 | Kim et al. | 345/67 |
| 2006/0250064 | A1 | 11/2006 | Park et al. | 313/112 |
| 2007/0075641 | A1* | 4/2007 | Yu | 313/587 |
| 2007/0181326 | A1* | 8/2007 | Naito et al. | 174/36 |
| 2007/0200797 | A1* | 8/2007 | Kim et al. | 345/60 |
| 2007/0223867 | A1* | 9/2007 | Hwang et al. | 385/123 |
| 2007/0247684 | A2* | 10/2007 | Wood | 359/19 |
| 2008/0074353 | A1* | 3/2008 | Bae | 345/60 |
| 2008/0272697 | A1* | 11/2008 | Cha et al. | 313/582 |

FOREIGN PATENT DOCUMENTS

| | | |
|---|---|---|
| CN | 1787051 A | 6/2006 |
| CN | 1797668 A | 7/2006 |
| CN | 1806187 A | 7/2006 |
| CN | 1841627 A | 10/2006 |

(Continued)

OTHER PUBLICATIONS

Chinese Office Action dated Jul. 31, 2009.

(Continued)

*Primary Examiner* — Quan-Zhen Wang
*Assistant Examiner* — Tony Davis
(74) *Attorney, Agent, or Firm* — KED & Associates, LLP

(57) ABSTRACT

A plasma display apparatus is disclosed. The plasma display apparatus includes a plasma display panel and a filter positioned in front of the plasma display panel. The plasma display panel includes a front substrate on which an upper dielectric layer is positioned, first and second electrodes positioned between the front substrate and the upper dielectric layer, and a rear substrate on which a third electrode is positioned to intersect the first and second electrodes. The filter includes a first portion having a first degree of blackness, and a second portion that is positioned in the first portion and has a second degree of blackness larger than the first degree of blackness. A black layer is omitted between the front substrate and the upper dielectric layer.

18 Claims, 23 Drawing Sheets

FOREIGN PATENT DOCUMENTS

| | | | |
|---|---|---|---|
| EP | 1 659 608 | A1 | 5/2006 |
| EP | 1 669 972 | A2 | 6/2006 |
| EP | 1 677 282 | A1 | 7/2006 |
| EP | 1 677 336 | A2 | 7/2006 |
| EP | 1 708 235 | A2 | 10/2006 |
| EP | 1 770 750 | A2 | 4/2007 |
| JP | 2000-352608 | A | 12/2000 |
| JP | 2001-307646 | A | 11/2001 |
| JP | 2002-050298 | A | 2/2002 |
| JP | 2004-286996 | A | 10/2004 |
| JP | 2005-340213 | A | 12/2005 |
| KR | 10-2003-0024887 | A | 3/2003 |
| KR | 10-2006-0001549 | A | 1/2006 |
| KR | 10-2006-0053533 | A | 5/2006 |
| KR | 10-0579713 | B1 | 5/2006 |
| KR | 10-2006-0104524 | A | 10/2006 |
| KR | 10-2007-0008352 | A | 1/2007 |

OTHER PUBLICATIONS

PCT International Search Report dated Jan. 23, 2008.
Korean Decision to Grant a Patent dated Mar. 18, 2008.
European Search Report for Application 07833572.6 dated Nov. 12, 2010.

* cited by examiner (a)

(b)

PLASMA DISPLAY APPARATUS

This application claims the benefit of Korean Patent Application No. 10-2006-0103946 filed on Oct. 25, 2006, which is hereby incorporated by reference.

BACKGROUND OF THE DISCLOSURE

1. Field of the Disclosure

This document relates to a plasma display apparatus.

2. Description of the Related Art

A plasma display apparatus includes a plasma display panel displaying an image and a filter positioned in front of the plasma display panel.

The plasma display panel includes phosphor layers inside discharge cells partitioned by barrier ribs and a plurality of electrodes. Driving signals are supplied to the discharge cells through the electrodes.

When the driving signal generates a discharge inside the discharge cells, a discharge gas filled in the discharge cells generates vacuum ultraviolet rays, which thereby cause phosphors formed inside the discharge cells to emit light, thus displaying an image on the screen of the plasma display panel.

SUMMARY OF THE DISCLOSURE

In one aspect, a plasma display apparatus comprises a plasma display panel including a front substrate on which an upper dielectric layer is positioned, a black layer being omitted between the front substrate and the upper dielectric layer, a first electrode and a second electrode positioned between the front substrate and the upper dielectric layer, and a rear substrate on which a third electrode is positioned to intersect the first electrode and the second electrode, and a filter positioned in front of the plasma display panel, the filter including a first portion having a first degree of blackness and a second portion that is positioned on the first portion and has a second degree of blackness larger than the first degree of blackness.

In another aspect, a plasma display apparatus comprises a plasma display panel including a front substrate on which an upper dielectric layer is positioned, a first electrode and a second electrode positioned between the front substrate and the upper dielectric layer, one surface of each of the first electrode and the second electrode contacting the front substrate, and the other surface of each of the first electrode and the second electrode contacting the upper dielectric layer, and a rear substrate on which a third electrode is positioned to intersect the first electrode and the second electrode, and a filter positioned in front of the plasma display panel, the filter including a first portion having a first degree of blackness and a second portion that is positioned on the first portion and has a second degree of blackness larger than the first degree of blackness.

In still another aspect, a plasma display apparatus comprises a plasma display panel including a front substrate on which an upper dielectric layer is positioned, a black layer being omitted between the front substrate and the upper dielectric layer, a first electrode and a second electrode positioned between the front substrate and the upper dielectric layer, and a rear substrate on which a third electrode is positioned to intersect the first electrode and the second electrode, and a filter positioned in front of the plasma display panel, the filter including a first portion having a first degree of blackness and a second portion that is positioned in the first portion and has a second degree of blackness larger than the first degree of blackness, wherein a first signal is supplied to the first electrode and a second signal of a polarity direction opposite a polarity direction of the first signal is supplied to the second electrode during a pre-reset period prior to a reset period of at least one subfield of a frame.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
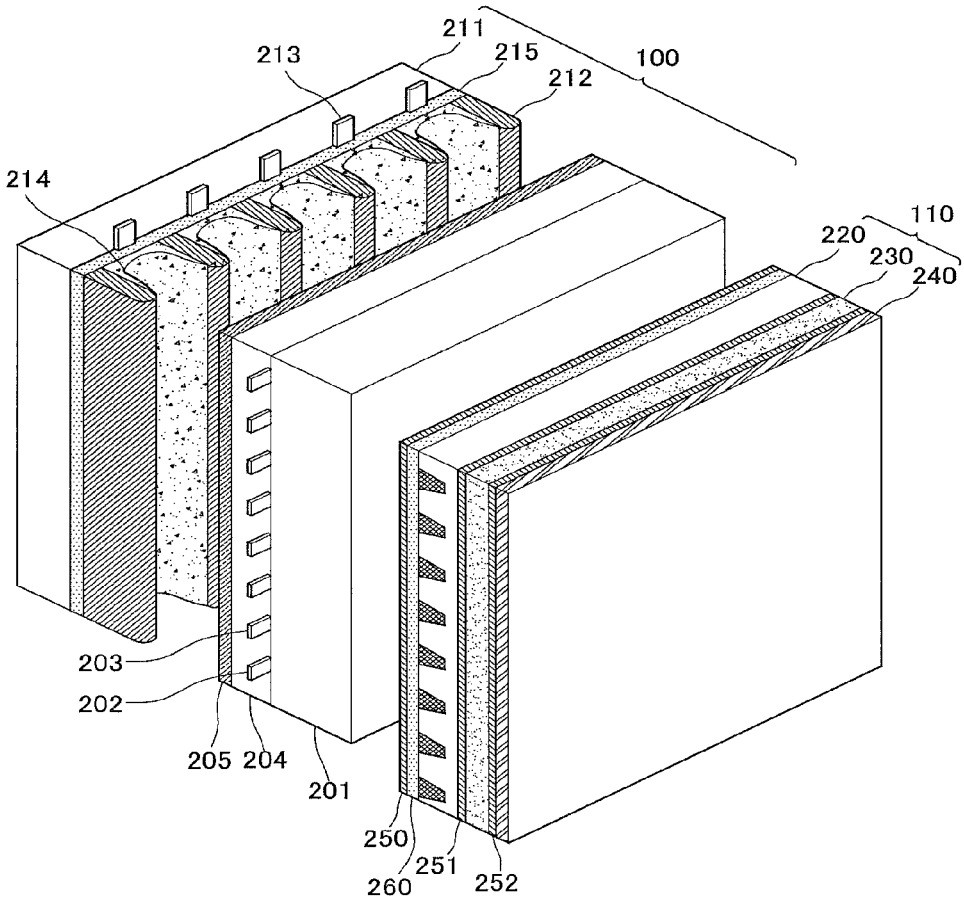
FIG. 1 illustrates a configuration of a plasma display apparatus according to an exemplary embodiment.

FIG. 1 illustrates a configuration of a plasma display apparatus according to an exemplary embodiment.

As illustrated in FIG. 1, the plasma display apparatus according to the exemplary embodiment includes a plasma display panel 100 displaying an image and a filter 110 positioned in front of the plasma display panel 100.

The plasma display panel 100 includes a front substrate 201 and a rear substrate 211 which coalesce to be opposite to each other. On the front substrate 201, a first electrode 202 and a second electrode 203 are positioned parallel to each other. On the rear substrate 211, a third electrode 213 is positioned to intersect the first electrode 202 and the second electrode 203.

An upper dielectric layer 204 for covering the first electrode 202 and the second electrode 203 is positioned on the front substrate 201 on which the first electrode 202 and the second electrode 203 are positioned. The upper dielectric layer 204 limits discharge currents of the first electrode 202 and the second electrode 203 and provides electrical insulation between the first electrode 202 and the second electrode 203.

A protective layer 205 is positioned on the upper dielectric layer 204 to facilitate discharge conditions. The protective layer 205 may include a material having a high secondary electron emission coefficient, for instance, magnesium oxide (MgO).

A lower dielectric layer 215 for covering the third electrode 213 is positioned on the rear substrate 211 on which the third electrode 213 is positioned. The lower dielectric layer 215 provides insulation of the third electrode 213.

Barrier ribs 212 of a stripe type, a well type, a delta type, a honeycomb type, and the like, are positioned between the front substrate 201 and the rear substrate 211 to partition discharge spaces (i.e., discharge cells). A red (R) discharge cell, a green (G) discharge cell, and a blue (B) discharge cell, and the like, are positioned between the front substrate 201 and the rear substrate 211.

In addition to the red (R), green (G), and blue (B) discharge cells, a white or yellow discharge cell may be further positioned.

Widths of the red (R), green (G), and blue (B) discharge cells may be substantially equal to one another. The width of at least one of the red (R), green (G), and blue (B) discharge cells may be different from the widths of the other discharge cells.

For instance, a width of the red (R) discharge cell is the smallest, and widths of the green (G) and blue (B) discharge cells are larger than the width of the red (R) discharge cell. Further, the width of the discharge cell determines a width of a phosphor layer 114 formed inside the discharge cell. For instance, a width of a blue (B) phosphor layer formed inside the blue (B) discharge cell is larger than a width of a red (R) phosphor layer formed inside the red (R) discharge cell. Further, a width of a green (G) phosphor layer formed inside the green (G) discharge cell is larger than the width of the red (R) phosphor layer formed inside the red (R) discharge cell. Hence, because the amount of blue light is more than the amount of red light, a color temperature of a displayed image is improved.

The plasma display panel 100 may have various forms of barrier rib structures. For instance, the barrier rib 112 may include a first barrier rib (not shown) and a second barrier rib (not shown) intersecting each other. The barrier rib 112 may have a differential type barrier rib structure in which a height of the first barrier rib and a height of the second barrier rib are different from each other, a channel type barrier rib structure in which a channel usable as an exhaust path is formed on at least one of the first barrier rib or the second barrier rib, a hollow type barrier rib structure in which a hollow is formed on at least one of the first barrier rib or the second barrier rib, and the like.

While the plasma display panel 100 has been illustrated and described to have the red (R), green (G), and blue (B) discharge cells arranged on the same line, it is possible to arrange them in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

The discharge cell partitioned by the barrier rib 212 is filled with a predetermined discharge gas. The phosphor 214 for emitting visible light for an image display during the generation of an address discharge is positioned inside the discharge cell. For instance, red (R), green (G) and blue (B) phosphors 214 may be positioned.

In addition to the red (R), green (G) and blue (B) phosphors 214, white or yellow phosphor may be positioned.

A thickness of at least one of the phosphor layers 114 inside the red (R), green (G) and blue (B) discharge cells may be different from thickness of the other phosphor layers. For instance, thicknesses of the phosphor layers inside the green (G) and blue (B) discharge cells are larger than a thickness of the phosphor layer inside the red (R) discharge cell.

The third electrode 113 may have a substantially constant width or thickness. Further, a width or thickness of the third electrode 113 inside the discharge cell may be different from a width or thickness of the third electrode 113 outside the discharge cell. For instance, a width or thickness of the third electrode 113 inside the discharge cell may be larger than a width or thickness of the third electrode 113 outside the discharge cell.

The filter 110 includes a shielding layer 220 for shielding light coming from the outside. The filter 110 further includes a color layer 230 and an electromagnetic interference (EMI) shielding layer 240.

A first adhesive layer 251 is positioned between the shielding layer 220 and the color layer 230 to attach the shielding layer 220 to the color layer 230. A second adhesive layer 252 is positioned between the color layer 230 and the EMI shielding layer 240 to attach the color layer 230 to the EMI shielding layer 240.

A reference numeral 260 indicates a substrate formed of a polymer resin-based material or a glass-based material. The substrate 260 provides formation spaces of the shielding layer 220, the color layer 230 and the EMI shielding layer 240.

A reference numeral 250 indicates a third adhesive layer positioned to attach the filter 110 to the plasma display panel 100. In case that the substrate 260 formed of a glass-based material is used, the third adhesive layer 250 may be omitted.

The filter 110 may further include a near infrared ray shielding layer.

Locations of the shielding layer 220, the color layer 230, the EMI shielding layer 240 and the substrate 260 may vary. For instance, the EMI shielding layer 240 may be positioned on the substrate 260, the color layer 230 may be positioned on the EMI shielding layer 240, and the shielding layer 220 may be positioned on the color layer 230.

Figure 2:
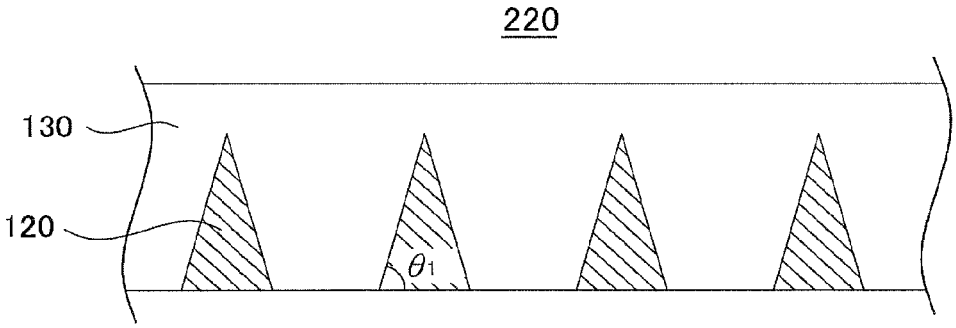
FIG. 2 illustrates a shielding layer of a filter.

FIG. 2 illustrates a shielding layer of a filter.

As illustrated in FIG. 2, the shielding layer 220 includes a first portion 130 and a second portion 120.

The first portion 130 may be formed of a substantially transparent material, for instance, a substantially transparent resin material. Supposing that the first portion 130 has a first degree of blackness.

The second portion 120 is positioned on the first portion 130 and has a second degree of blackness larger than the first degree of blackness. In other words, the second portion 120 is darker than the first portion 130. For instance, the second portion 120 may be formed of a carbon-based material and may be substantially black.

The second portion 120 has a gradually decreasing width as it goes toward the first portion 130. Accordingly, one side of the first portion 130 parallel to the base of the second portion 120 and one side of the second portion 120 may form a predetermined angle θ1. The angle θ1 may be equal to or more than about 70° and less than about 90°.

Figure 3:
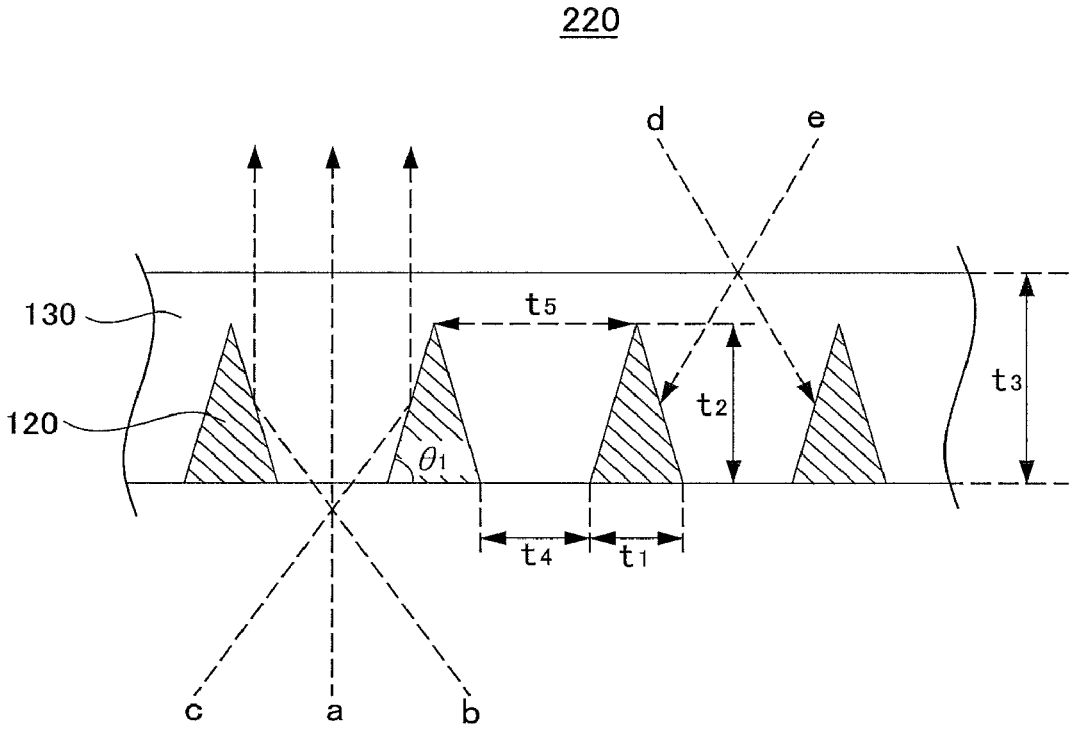
FIG. 3 is a diagram for explaining a function of a shielding layer.

FIG. 3 is a diagram for explaining a function of a shielding layer.

As illustrated in FIG. 3, light coming from a point "a" (i.e., positioned inside the plasma display panel) positioned inside the filter is directly emitted to the outside of the plasma display panel. Light coming from points "b" and "c" positioned inside the filter is totally reflected by the second portion 120 and then is emitted to the outside. However, light coming from points "d" and "e" (i.e., positioned outside the plasma display panel) positioned outside the filter is absorbed into the second portion 120.

When a refractive index of the second portion 120 is smaller than a refractive index of the first portion 130 and one side of the first portion 130 parallel to the base of the second portion 120 and one side of the second portion 120 form the predetermined angle θ1, light coming from the inside of the filter can be emitted more efficiently to the outside and light coming from the outside of the filter can be absorbed more efficiently. Hence, contrast of an image displayed on the plasma display panel can be improved.

To more effectively absorb light coming from the outside of the filter and to more effectively emit light coming from the inside of the filter, the refractive index of the second portion 120 may range from 0.8 to 0.999 times the refractive index of the base portion 420.

A height t3 of the first portion 130 may range from 1.01 to 2.25 times a height t2 of the second portion 120. Hence, a yield increase in a manufacturing process and the durability of the filter can be sufficiently secured, light coming from the outside of the filter can be sufficiently blocked, and transparency of light coming from the inside of the filter can be sufficiently secured.

Furthermore, a shortest interval t4 between the second portions 120 may range from 1.1 to 5 times a width t1 of the base of the second portion 120. Hence, an aperture ratio of the filter can be sufficiently secured, light coming from the outside of the filter is sufficiently blocked, and the second portion 120 can be easily manufactured.

Furthermore, a longest interval t5 between the second portions 120 may range from 1.1 to 3.25 times the shortest interval t4 between the second portions 120. Hence, the aperture ratio of the filter is sufficiently secured, and the angle θ1 of the second portion 120 can be set to an ideal value so that light coming from the outside of the filter is sufficiently blocked.

A height t2 of the second portion 120 may range from 0.89 to 4.25 times the shortest interval t4 between the second portions 120. Hence, the aperture ratio of the filter is sufficiently secured, and light coming from the outside of the filter is sufficiently blocked.

For instance, the width t1 of the base of the second portion 120 may range from 18 μm to 35 μm.

The height t2 of the second portion 120 may range from 80 μm to 170 μm.

A height t3 of the first portion 130 may range from 100 μm to 180 μm.

The shortest interval t4 between the second portions 120 may range from 40 μm to 90 μm.

The longest interval t5 between the second portions 120 may range from 90 μm to 130 μm.

FIGS. 4A to 4E illustrate various forms of shielding layer.

Figure 4A:
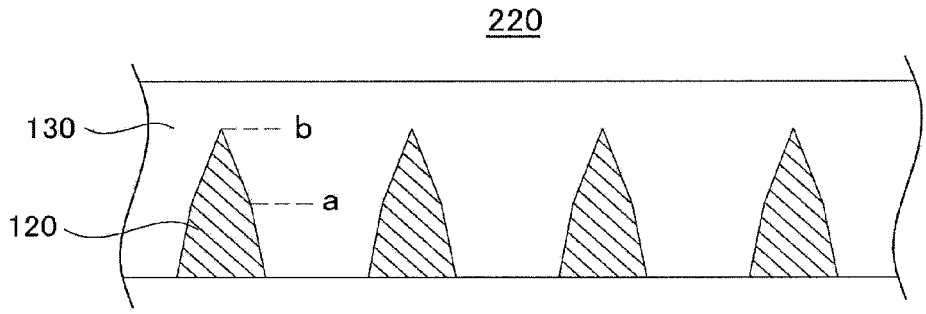
FIGS. 4A to 4E illustrate various forms of shielding layer.

As illustrated in FIG. 4A, the second portion 120 may include a portion having a first width at a point "a" and a portion having a second width at a point "b". For instance, the second portion 120 may include two portions each having a width of a different decreasing ratio as it goes toward an internal direction of the first portion 130. In other words, the width of the second portion 120 decreases with the first ratio up to the point "a" and decreases with a second ratio larger than an the first ratio, from the point "a" to the point "b".

Figure 4B:
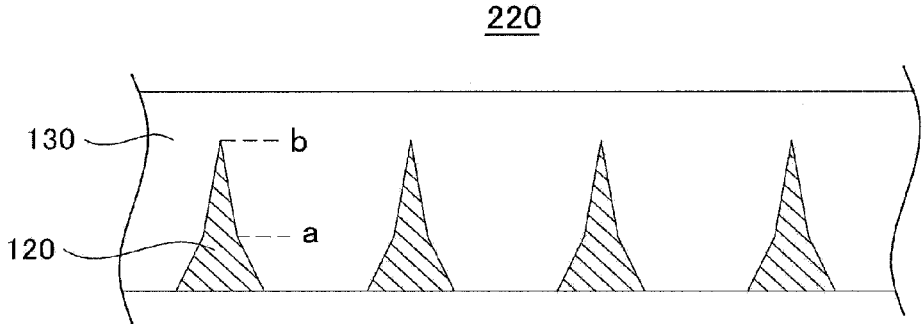

As illustrated in FIG. 4B, unlike FIG. 4A, the width of the second portion 120 decreases with a first ratio up to a point "a" and decreases with a second ratio smaller than the first ratio from the point "a" to a point "b".

Figure 4C:
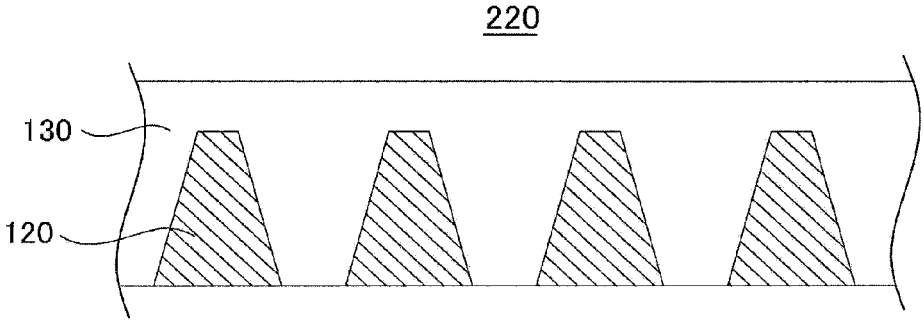

As illustrated in FIG. 4C, a tip of the second portion 120 has a substantially flat form.

Figure 4D:
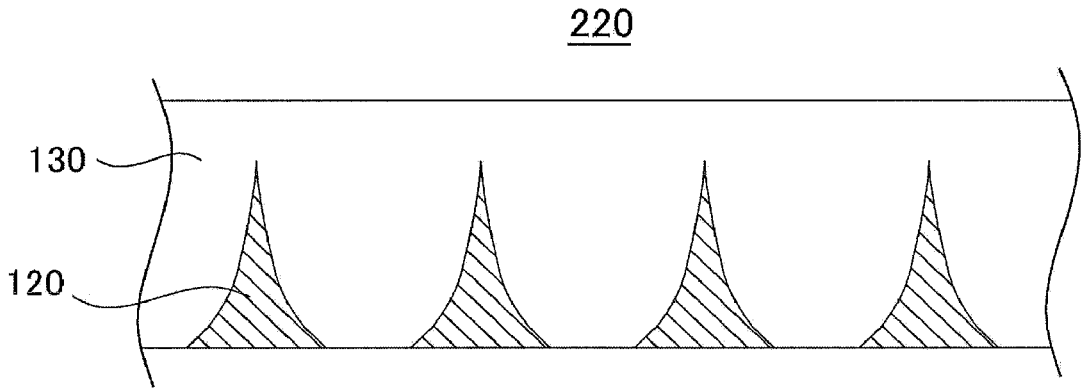

As illustrated in FIG. 4D, a side surface of the second portion 120 forms a smooth curved line.

Figure 4E:
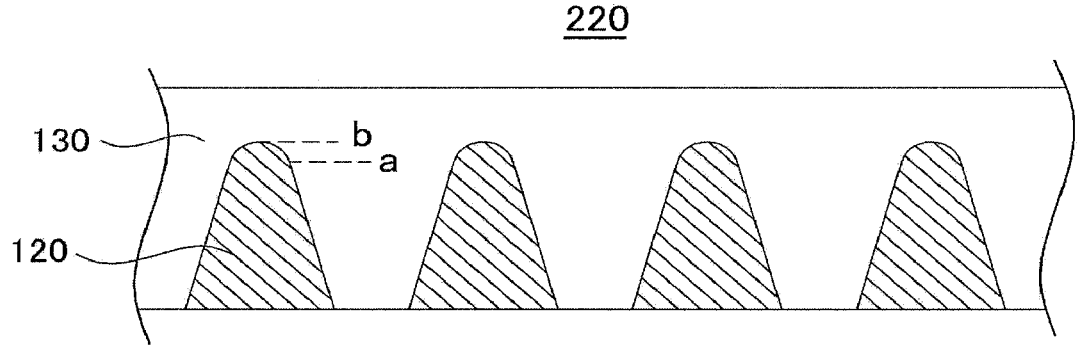

As illustrated in FIG. 4E, a side surface of the second portion 120 is a substantially straight line form up to a point "a" and is a curved line form from the point "a" to a point "b". For instance, the second portion 120 has a tip with a curved surface.

Figure 5A:
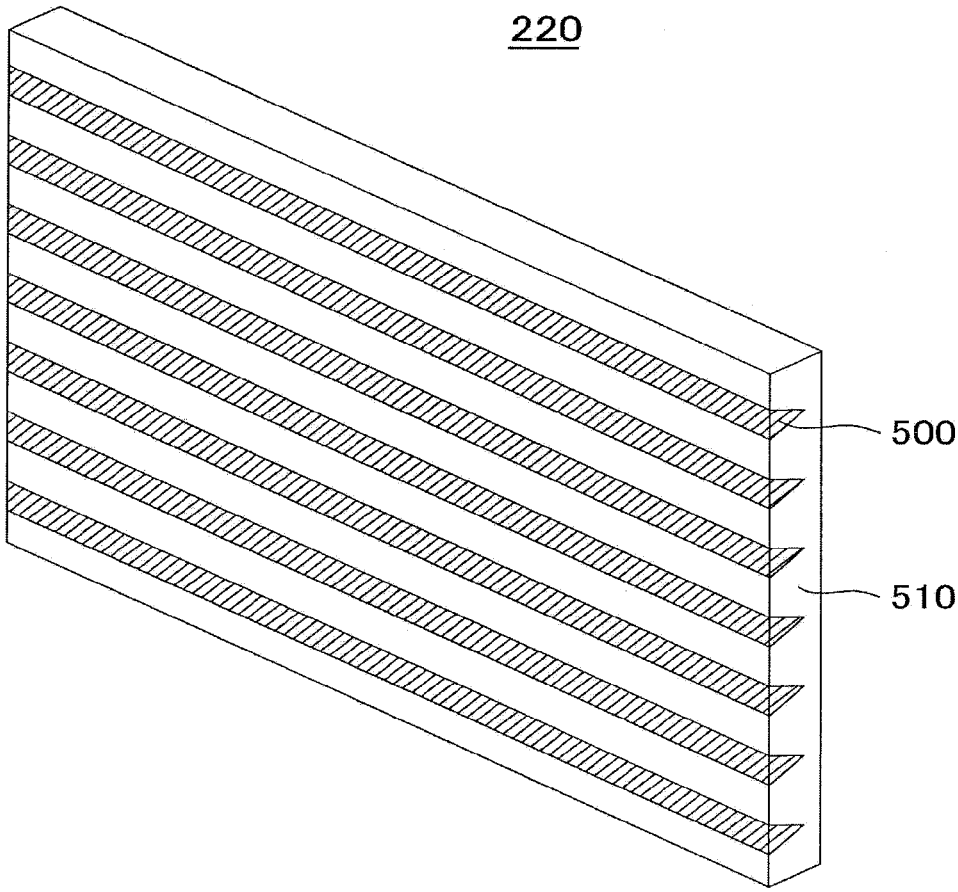
FIGS. 5A and 5B is a diagram for explaining a traveling direction of a second portion.
Figure 5B:
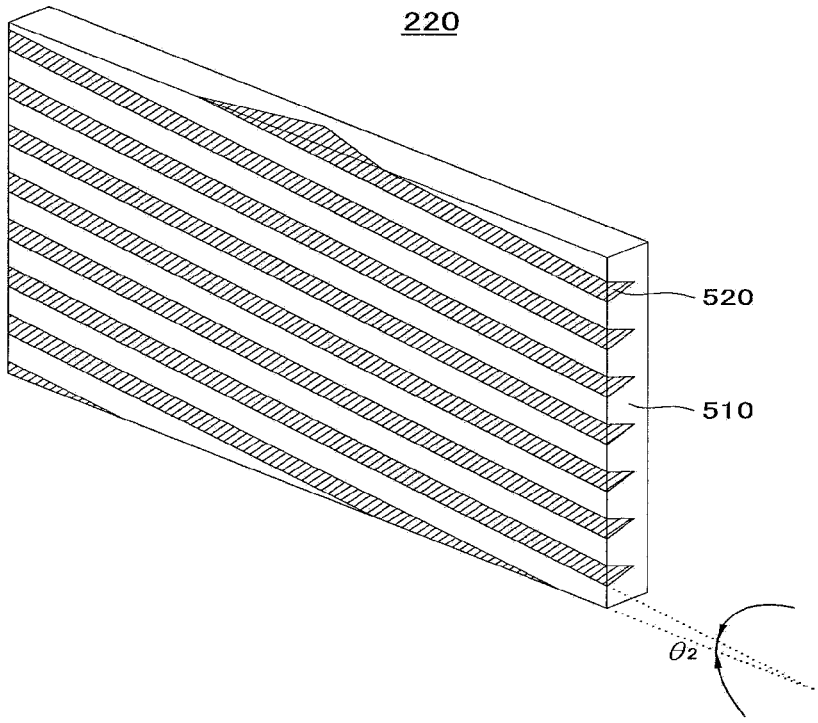

FIGS. 5A and 5B is a diagram for explaining a traveling direction of a second portion.

As illustrated in FIG. 5A, a traveling direction of a second portion 500 and a longer side of a first portion 510 are substantially parallel to each other.

As illustrated in FIG. 5B, a traveling direction of a second portion 520 and a long side of a first portion 510 form a predetermined angle θ2.

As above, when the traveling direction of the second portion 520 and the long side of the first portion 510 form the predetermined angle θ2, an interference fringe (i.e., Moire fringe) produced when two or more periodic patterns overlap can be efficiently prevented. To more effectively prevent Moire fringe, the predetermined angle θ2 may range from about 5° to 80°.

Figure 6A:
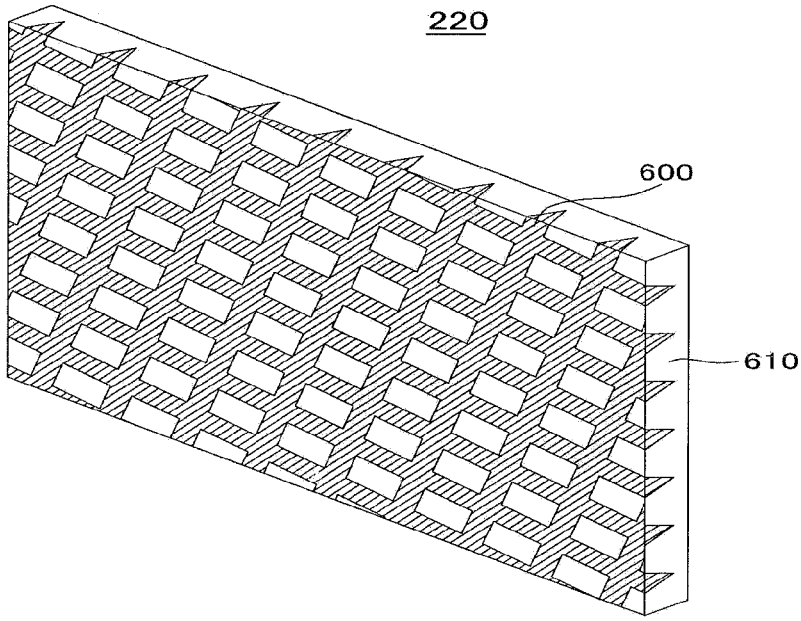
FIGS. 6A to 6C illustrate various types of a shielding layer.
Figure 6B:
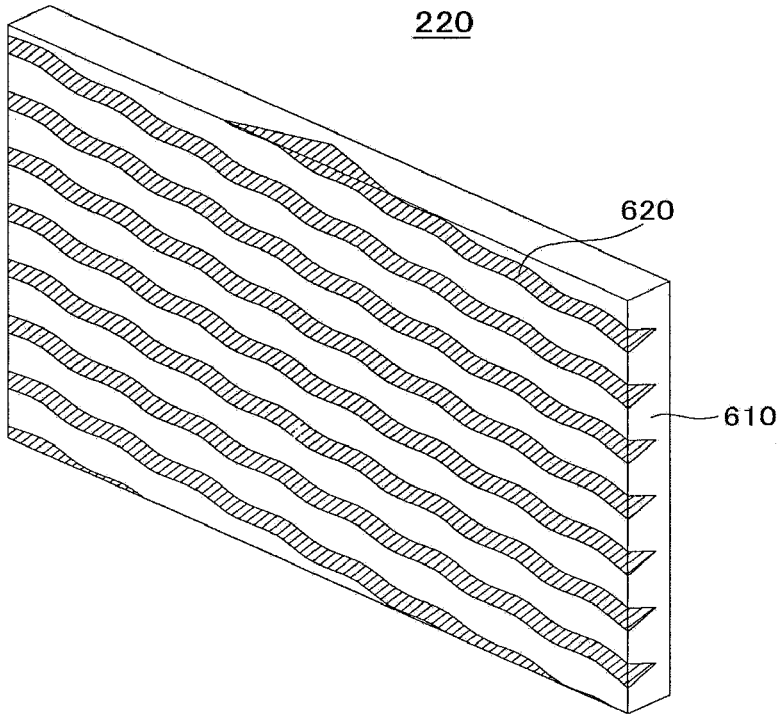
Figure 6C:
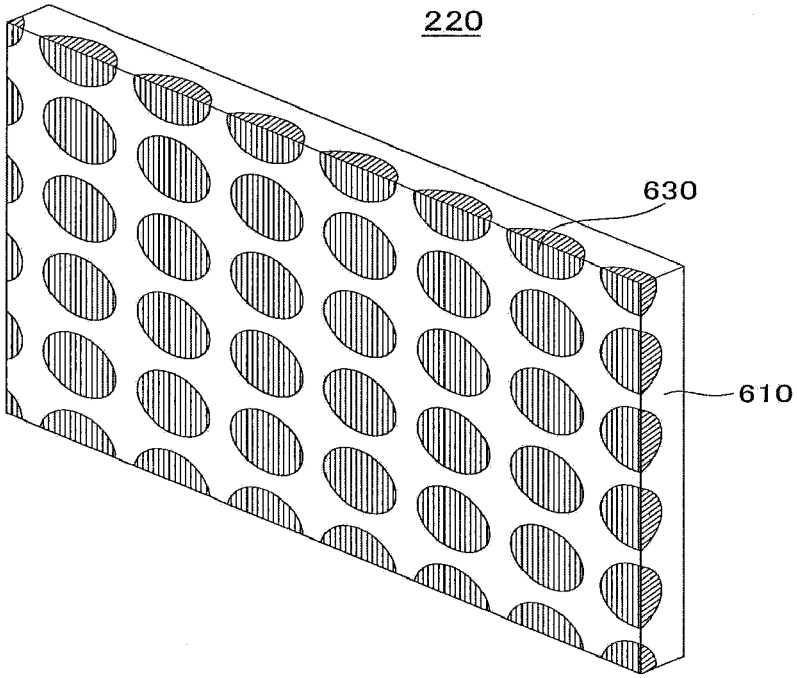

FIGS. 6A to 6C illustrate various types of a shielding layer.

As illustrated in FIG. 6A, a second pattern portion 600 of the shielding layer 220 may be formed in a matrix type.

As illustrated in FIG. 6B, a second portion 620 may be formed in a wave type.

As illustrated in FIG. 6C, a second portion 630 may be formed in a protrusion type. For instance, the plurality of the protrusion type second portions 630 having a hemisphere shape are spaced apart from each other with a predetermined distance therebetween.

Figure 7:
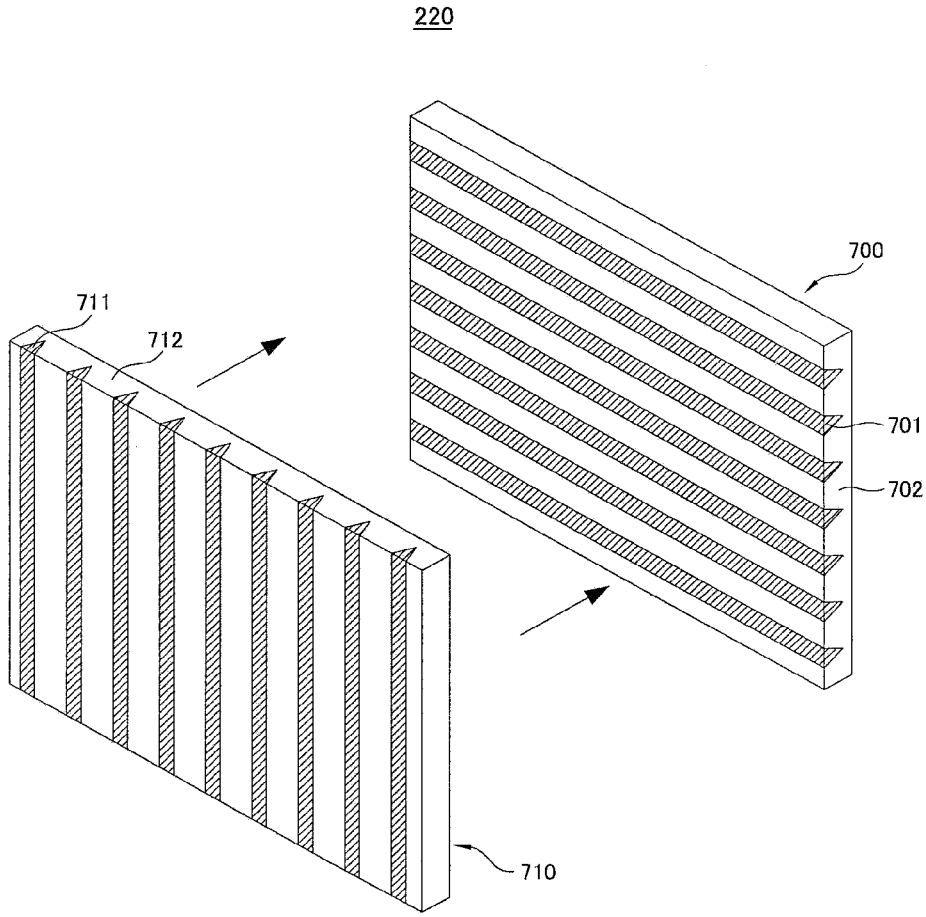
FIG. 7 illustrates an example of a case of using two or more shielding layers each having a different pattern.

FIG. 7 illustrates an example of a case of using two or more shielding layers each having a different pattern.

As illustrated in FIG. 7, two shielding layers 700 and 710, which have second portions 701 and 711 each having a different travelling direction, respectively, may be included in one filter.

As above, when two or more shielding layers each having a different pattern are used together, a viewing angle of the filter can be variously controlled.

Figure 8:
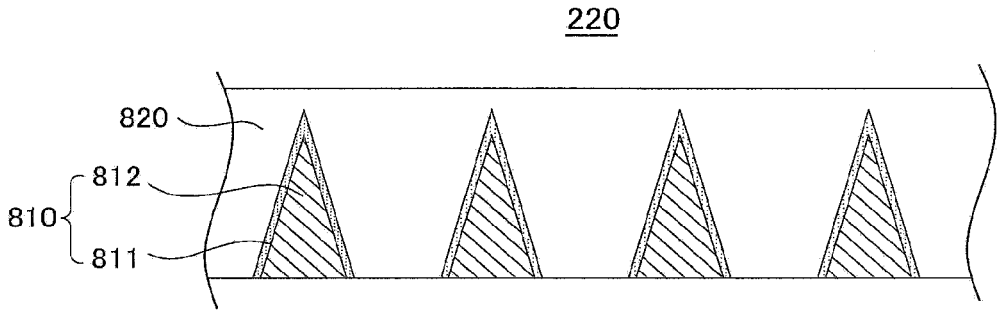
FIG. 8 illustrates another structure of a shielding layer.

FIG. 8 illustrates another structure of a shielding layer,

As illustrated in FIG. 8, a second portion 810 of the shielding layer 220 includes a plurality of layers. For instance, the second portion 810 includes an external layer 811 and an internal layer 812. The external layer 811 may be formed to cover the internal layer 812.

A refractive index of the external layer 811 may be smaller than a refractive index of a first portion 820, and a refractive index of the internal layer 812 may be different from or equal to the refractive index of the external layer 811. For instance, the refractive index of the internal layer 812 is smaller than the refractive index of the external layer 811.

Figure 9A:
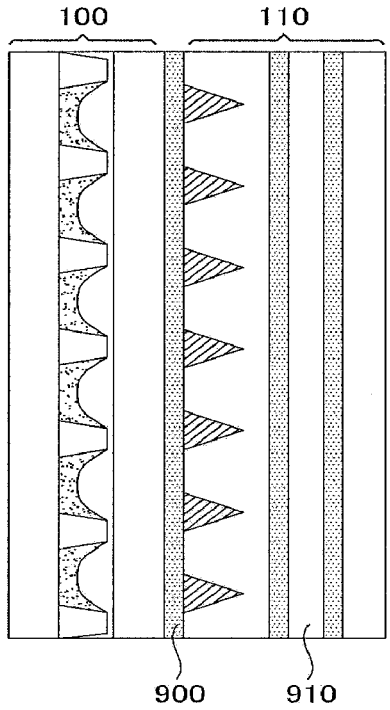
FIGS. 9A and 9B illustrate a film type filter and a glass type filter, respectively.
Figure 9B:
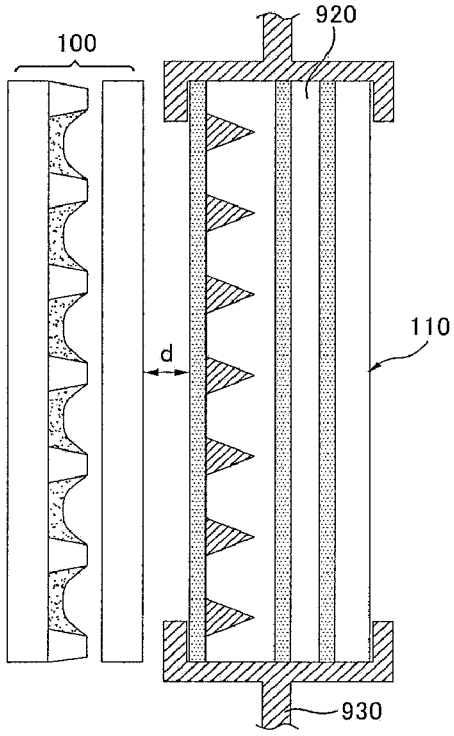

FIGS. 9A and 9B illustrate a film type filter and a glass type filter, respectively.

As illustrated in FIG. 9A, an adhesive layer 900 is positioned on a front surface of the plasma display panel 100, and the filter 110 is attached to the adhesive layer 900. For instance, the filter 110 may be attached to the front surface of the plasma display panel 100 using a method such as laminating. The filter 110 is called a film type filter.

A reference numeral 910 indicates a substrate formed of a resin-based material.

As illustrated in FIG. 9B, the filter 110 may be spaced apart from the plasma display panel 100 at a predetermined distance d. For instance, the filter 110 is supported by a supporter 930 to be spaced apart from the front surface of the plasma display panel 100 at the predetermined distance d. In this case, the filter 110 is called a glass type filter. A reference numeral 920 indicates a substrate formed of a glass-based material.

Figure 10A:
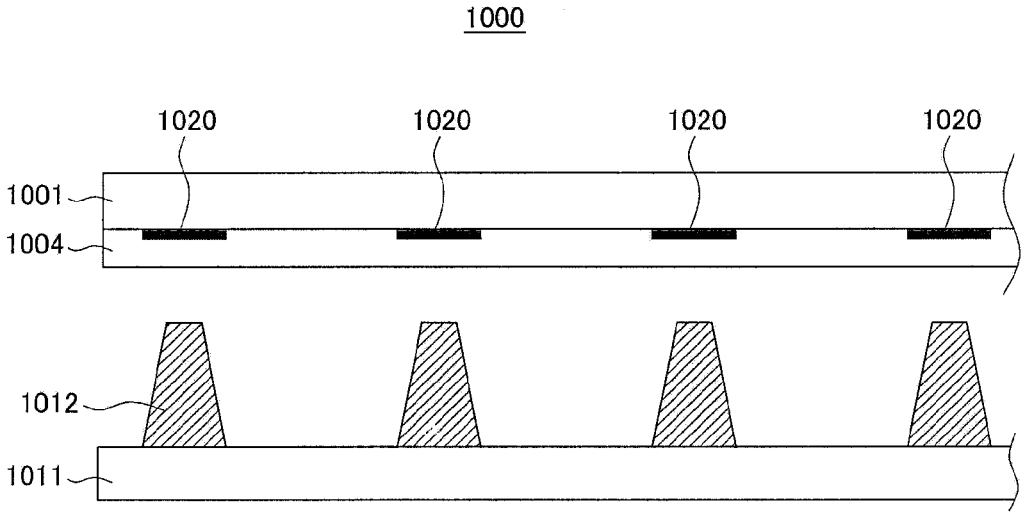
FIGS. 10A to 10C are diagrams for explaining the omission of a black layer in an area corresponding to a barrier rib.
Figure 10B:
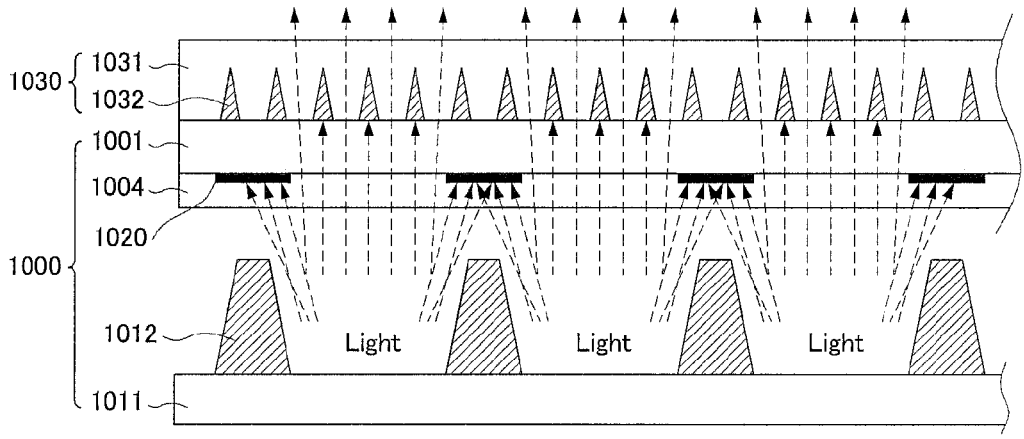
Figure 10C:
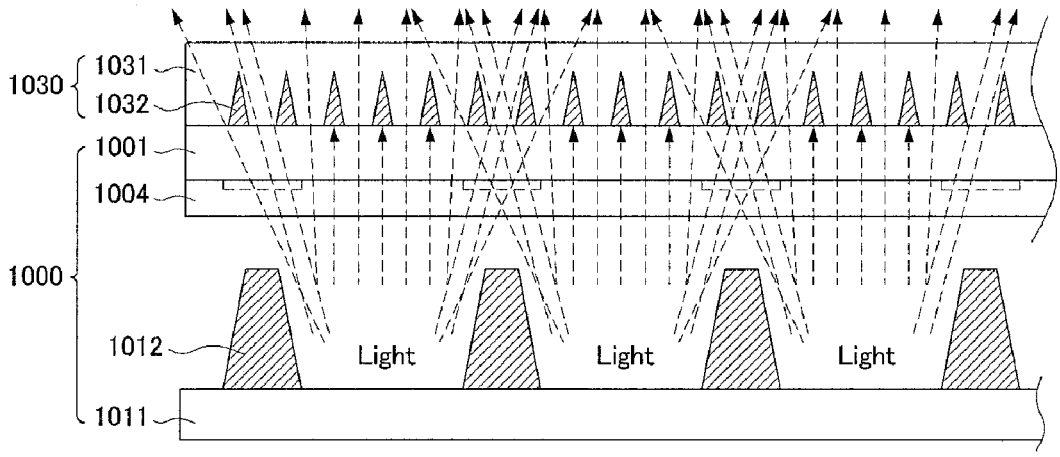

FIGS. 10A to 10C are diagrams for explaining the omission of a black layer in an area corresponding to a barrier rib.

FIG. 10A illustrates a case where a first black layer 1020 is positioned between a front substrate 1001 and an upper dielectric layer 1004. For instance, the first black layer 1020 is positioned between the front substrate 1001 and the upper dielectric layer 1004 at a location corresponding to a barrier rib 1012.

In FIG. 10A, since the first black layer 1020 absorbs light coming from the outside, the generation of reflection light caused by the barrier rib 1012 can be reduced. Hence, a contrast characteristic can be improved.

As illustrated in FIG. 10B, in case that the first black layer 1020 is positioned between the front substrate 1001 and the upper dielectric layer 1004, a filter positioned in front of a plasma display panel 1000 includes a shielding layer 1030 including a first portion 1031 and a second portion 1032.

In this case, it is likely that the first black layer 1020 absorbs light coming from the outside. However, when light coming from the inside of the plasma display panel 1000 is emitted to the outside, the light is shielded by the shielding layer 1030 and the first black layer 1020. Hence, a luminance of an image is excessively reduced and a contrast characteristic is bad.

As illustrated in FIG. 10C, when the first black layer is omitted between the front substrate 1001 and the upper dielectric layer 1004, the upper dielectric layer 1004 contacts the front substrate 1001 at a location corresponding to the barrier rib 1012.

Since light coming from the inside of the plasma display panel 1000 can be emitted to the outside without the hindrance of the first black layer, a reduction in a luminance can be prevented. Since the filter including the shielding layer 1030 is positioned in front of the plasma display panel 1000, the shielding layer 1030 can absorb sufficiently light coming from the outside of the plasma display panel 1000. Accordingly, although the first black layer is omitted, an excessive increase in the generation of reflection light caused by the barrier rib 1012 can be prevented.

To prevent a reduction in a luminance of an image while the contrast characteristic is maintained at a high level, when the filter positioned in front of the plasma display panel 1000 includes the shielding layer 1030 including the first portion 1031 and the second portion 1032, the first black layer may be omitted between the upper dielectric layer 1004 and the front substrate 1001. In other words, the upper dielectric layer 1004 contacts the front substrate 1001 at a location corresponding to the barrier rib 1012.

Figure 11A:
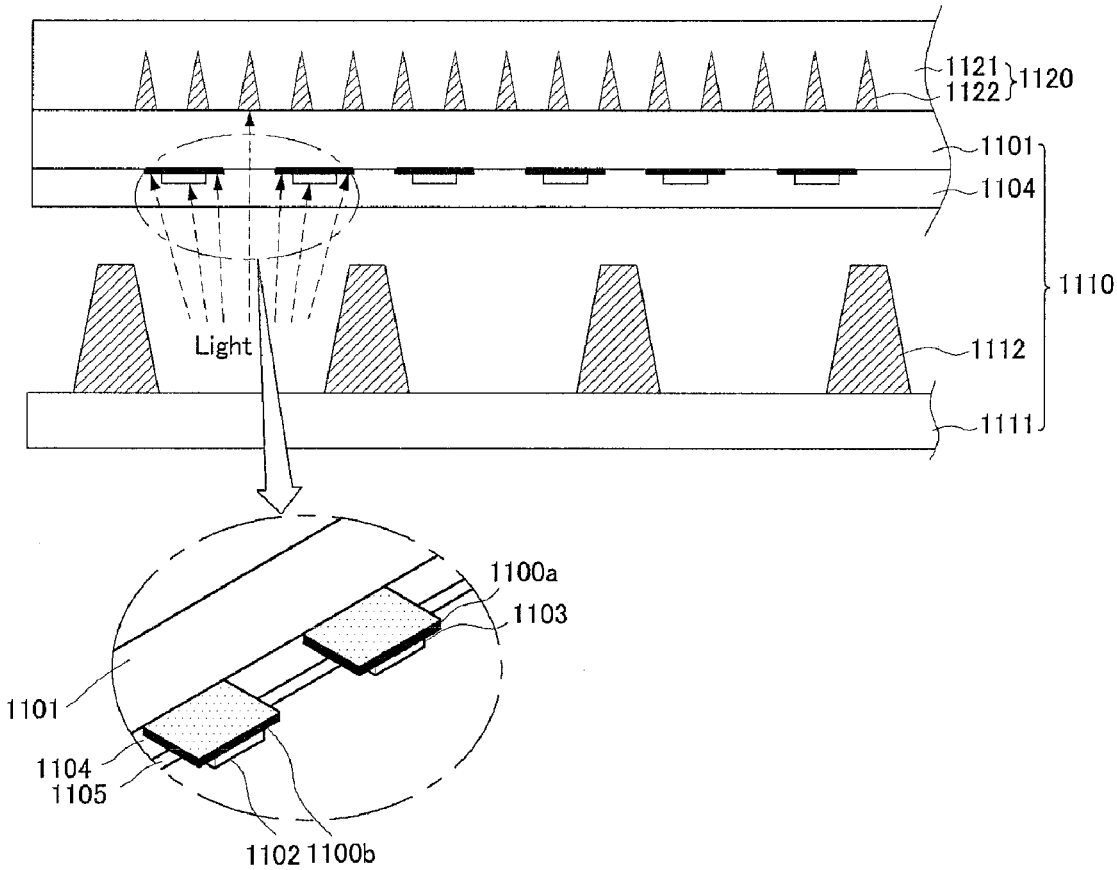
FIGS. 11A and 11B are diagrams for explaining the omission of a black layer in an area corresponding to a first electrode and a second electrode.
Figure 11B:
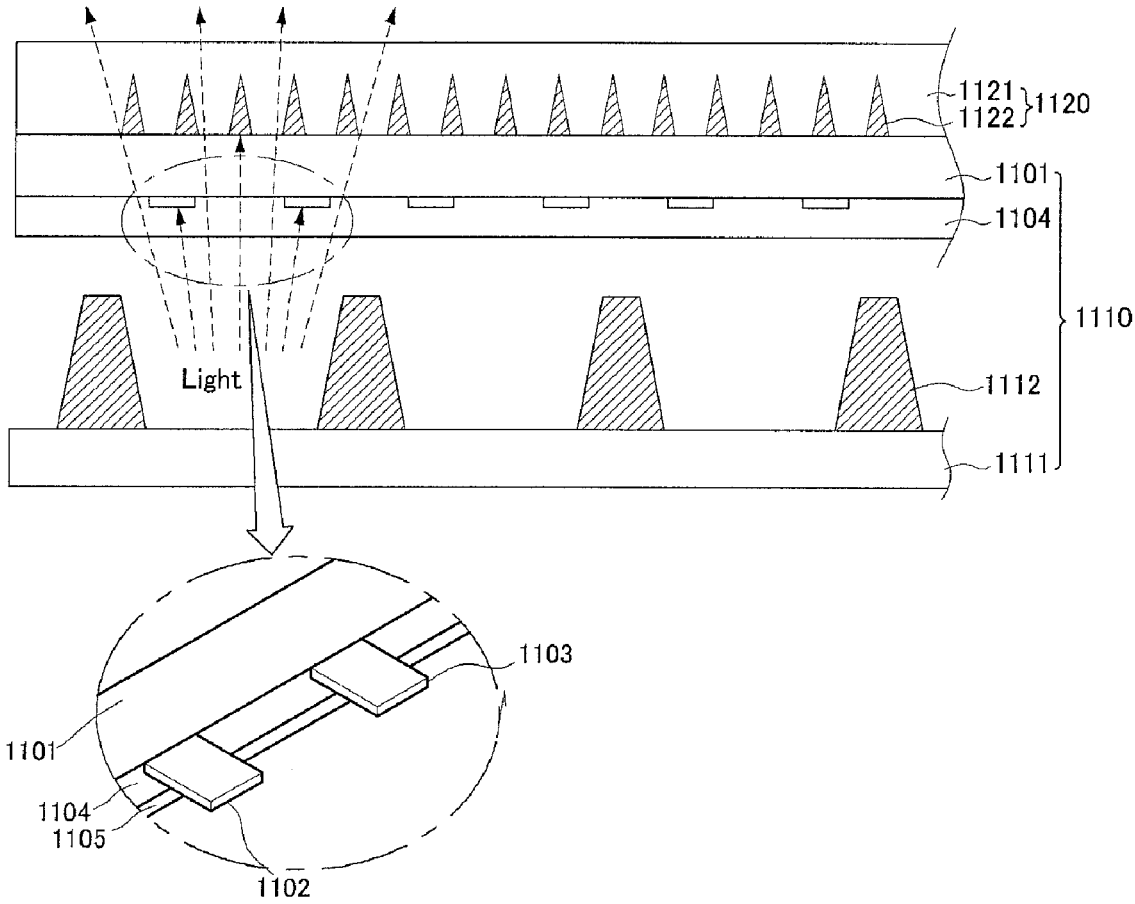

FIGS. 11A and 11B are diagrams for explaining the omission of a black layer in an area corresponding to a first electrode and a second electrode.

FIG. 11A illustrates a case where second black layers 1100*a* and 1100*b* with a color darker than colors of a first electrode 1102 and a second electrode 1103 are positioned between a front substrate 1101 and an upper dielectric layer 1104. In other words, the second black layers 1100*a* and 1100*b* are positioned between the front substrate 1101 and the second electrode 1103 and between the front substrate 1101 and the first electrode 1102, respectively.

The second black layers 1100*a* and 1100*b* suppress light coming from the outside from being reflected by the first electrode 1102 and the second electrode 1103, and thus contribute to the improvement of a contrast characteristic.

When a filter positioned in front of a plasma display panel 1110 includes a shielding layer 1120 including a first portion 1121 and a second portion 1122, it is likely that the second black layers 1100*a* and 1100*b* absorb light coming from the outside. However, when light coming from the inside of the plasma display panel 1110 is emitted to the outside, the light is shielded by the shielding layer 1120 and the second black layers 1100*a* and 1100*b*. Hence, a luminance of an image is excessively reduced and a contrast characteristic is bad.

As illustrated in FIG. 11B, when the second black layer is omitted in an area corresponding to the first electrode 1102 and the second electrode 1103 between the front substrate 1101 and the upper dielectric layer 1104, one surface of each of the first electrode 1102 and the second electrode 1103 contacts the front substrate 1101 and the other surface of each of the first electrode 1102 and the second electrode 1103 contacts the upper dielectric layer 1104.

Since light coming from the inside of the plasma display panel 1110 can be emitted to the outside without the hindrance of the second black layer, a reduction in a luminance can be prevented. Since the filter including the shielding layer 1120 is positioned in front of the plasma display panel 1110, the shielding layer 1120 can absorb sufficiently light coming from the outside of the plasma display panel 1000. Accordingly, although the second black layer is omitted, an excessive increase in the generation of reflection light caused by the first electrode 1102 and the second electrode 1103 can be prevented.

To prevent a reduction in the luminance of the image while the contrast characteristic is maintained at a high level, when the filter positioned in front of the plasma display panel 1110 includes the shielding layer 1120 including the first portion 1121 and the second portion 1122, the second black layer may be omitted in the area corresponding to the first electrode 1102 and the second electrode 1103 between the upper dielectric layer 1104 and the front substrate 1101. In other words, one surface of each of the first electrode 1102 and the second electrode 1103 contacts the front substrate 1101 and the other surface of each of the first electrode 1102 and the second electrode 1103 contacts the upper dielectric layer 1104.

As above, when the black layer is omitted between the upper dielectric and the front substrate, process time required in a manufacturing process of the black layer and the manufacturing cost can be reduced. Hence, the manufacturing cost of the plasma display apparatus can be reduced.

Figure 12A:
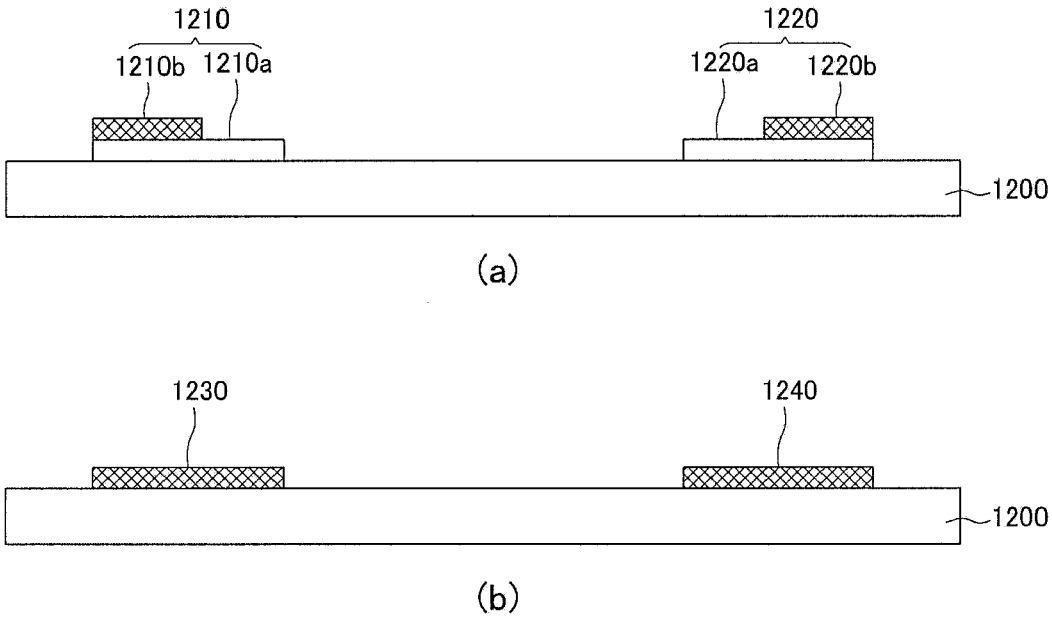
FIGS. 12A and 12B are diagrams for explaining the structure of a first electrode and a second electrode.
Figure 12B:
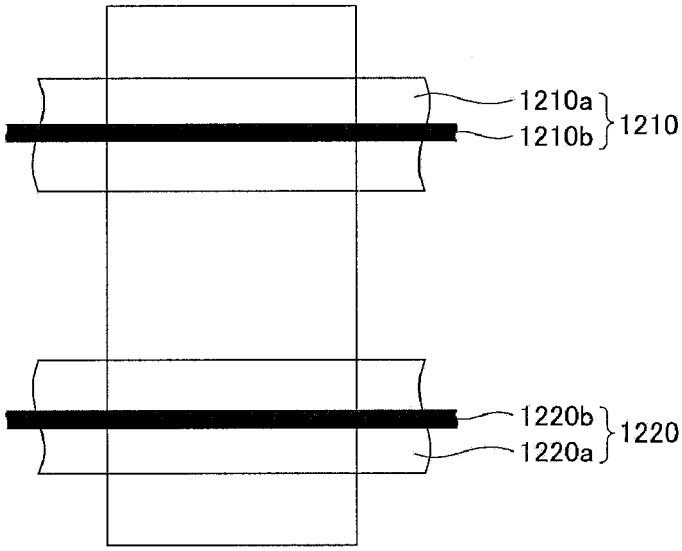
Figure 12B:
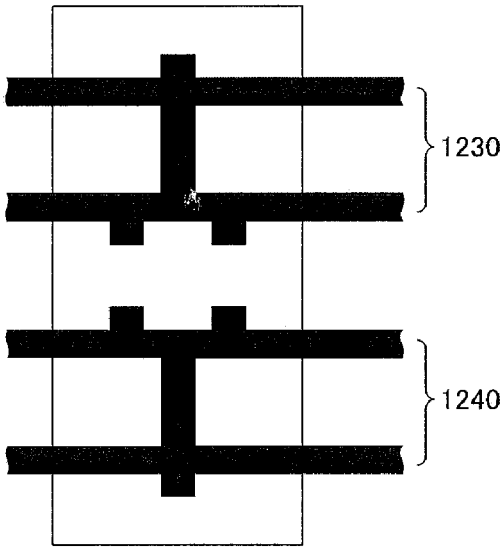

FIGS. 12A and 12B are diagrams for explaining the structure of a first electrode and a second electrode.

As illustrated in (a) of FIG. 12A, a first electrode 1210 and a second electrode 1220 each have a multi-layered structure on a front substrate 1200.

For instance, the first electrode 1210 and the second electrode 1220 each include transparent electrodes 1210*a* and 1220*a* and bus electrodes 1210*b* and 1220*b*.

The transparent electrodes 1210*a* and 1220*a* may include a transparent material such as indium-tin-oxide (ITO). The bus electrodes 1210*b* and 1220*b* may include a-metal material such as silver (Ag).

The transparent electrodes 1210*a* and 1220*a* are formed and then the bus electrodes 1210*b* and 1220*b* are formed to complete the first electrode 1210 and the second electrode 1220.

As illustrated in (b) of FIG. 12A, a first electrode 1230 and a second electrode 1240 each have a single-layered structure on the front substrate 1200. For instance, at least one of the first electrode 1230 and the second electrode 1240 may be called an ITO-less electrode in which a transparent electrode is omitted.

At least one of the first electrode 1230 or the second electrode 1240 may include a substantially opaque metal material with excellent electrical conductivity. Examples of the opaque metal with excellent electrical conductivity include silver (Ag), copper (Cu) and aluminum (Al) that are cheaper than ITO. At least one of the first electrode 1230 or the second electrode 1240 may further include a black material such as carbon (C), cobalt (Co) or ruthenium (Ru).

A process for forming the transparent electrodes 1210*a* and 1220*a* and a process for forming the bus electrodes 1210*b* and 1220*b* are required in (a) of FIG. 12A. However, because a process for forming the transparent electrode is omitted in (b) of FIG. 12A, the manufacturing cost can be reduced.

Further, because an expensive material such as ITO is not used in (b) of FIG. 12A, the manufacturing cost can be further reduced.

As illustrated in FIG. 12B, (a) illustrates a case where the first electrode 1210 and the second electrode 1220 each have a multi-layered structure, and (b) illustrates a case where the first electrode 1230 and the second electrode 1240 each have a single-layered structure.

Because the first electrode 1210 and the second electrode 1220 each include the transparent electrodes 1210*a* and 1220*a* and the bus electrodes 1210*b* and 1220*b* in (a) of FIG. 12B, the electrical conductivity of the first electrode 1210 and the second electrode 1220 does not greatly decrease although areas of the bus electrodes 1210*b* and 1220*b* is relatively small. Hence, an excessive reduction in the driving efficiency can be prevented and an aperture ratio can be maintained at a high level.

On the contrary, because the transparent electrode is omitted in (b) of FIG. 12B, the electrical conductivity of the first electrode 1230 and the second electrode 1240 can be maintained at a sufficiently high level by sufficiently widening areas of the first electrode 1230 and the second electrode 1240. Hence, the aperture ratio of the panel is excessively reduced and the luminance of displayed image can be excessively reduced.

To prevent a reduction in the luminance in the first electrode 1230 and the second electrode 1240 each having the single-layered structure, the black layer may be omitted between the upper dielectric layer and the front substrate in the same way as FIG. 10C or 11*b*.

FIGS. 13A to 13D illustrate a first implementation associated with first and second electrodes in the plasma display panel of the plasma display apparatus according to the exemplary embodiment.

Figure 13A:
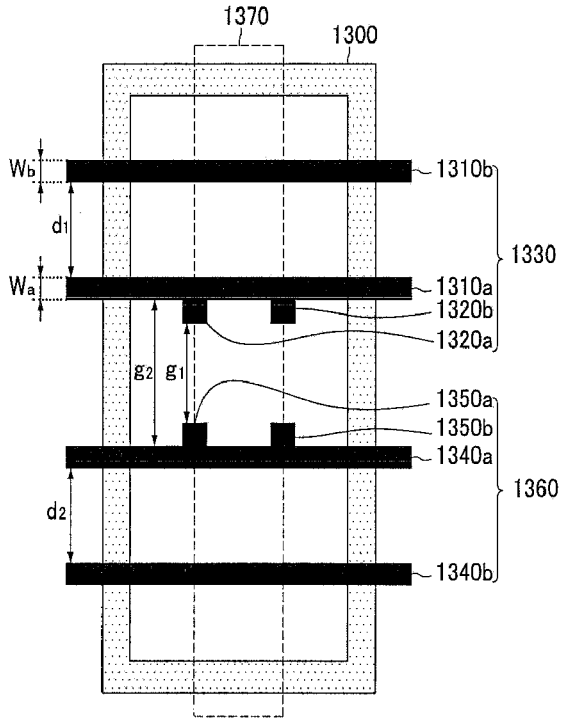
FIGS. 13A to 13D illustrate a first implementation associated with first and second electrodes in the plasma display panel of the plasma display apparatus according to the exemplary embodiment.

As illustrated in FIG. 13A, at least one of a first electrode 1330 or a second electrode 1360 may include at least one line portion. The first electrode 1330 includes two line portions 1310*a* and 1310*b*, and the second electrode 1360 includes two line portions 1340*a* and 1340*b*.

The line portions 1310*a*, 1310*b*, 1340*a* and 1340*b* each intersect a third electrode 1370 inside a discharge cell partitioned by a barrier rib 1300.

The line portions 1310*a*, 1310*b*, 1340*a* and 1340*b* are spaced apart from one another with a predetermined distance therebetween. For instance, the first and second line portions 1310*a* and 1310*b* of the first electrode 1330 are spaced apart from each other with a distance d1 therebetween. The first and second line portions 1440*a* and 1440*b* of the second electrode 1460 are spaced apart from each other with a distance d2 therebetween. The distance d1 may be equal to or different from the distance d2.

The line portions 1310*a*, 1310*b*, 1340*a* and 1340*b* may have a predetermined width. For instance, the first line portion 1310*a* of the first electrode 1330 has a width Wa, and the second line portion 1310*b* of the first electrode 1330 has a width Wb.

A shape of the first electrode 1330 may be symmetrical or asymmetrical to a shape of the second electrode 1360 inside the discharge cell. For instance, while the first electrode 1330 may include three line portions, the second electrode 1360 may include two line portions.

The number of line portions in the first and second electrodes 1330 and 1360 may vary. For instance, the first electrode 1330 or the second electrode 1360 may include 4 or 5 line portions.

At least one of the first electrode 1330 or the second electrode 1360 may include at least one projecting portion. For instance, the first electrode 1330 includes two projecting portions 1320*a* and 1320*b*, and the second electrode 1360 includes two projecting portions 1350*a* and 1350*b*.

The projecting portions 1320*a* and 1320*b* of the first electrode 1330 project from the first line portion 1310*a*, and the projecting portions 1350*a* and 1350*b* of the second electrode 1360 project from the first line portion 1340*a*. The projecting portions 1320*a*, 1320*b*, 1350*a* and 1350*b* are parallel to the third electrode 1370.

An interval g1 between the first and second electrodes 1330 and 1360 at the projecting portions 1320*a*, 1320*b*, 1350*a* and 1350*b* is shorter than an interval g2 between the first and second electrodes 1330 and 1360 in the discharge cell. Accordingly, a firing voltage of a discharge generated between the first electrode 1330 and the second electrode 1360 can be lowered.

Figure 13B:
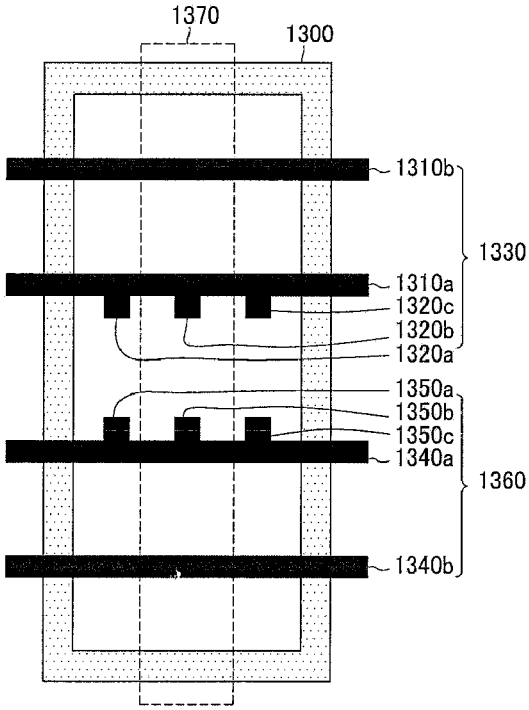

While the first electrode 1330 and the second electrode 1360 each include two projecting portions in FIG. 13A, each of the first electrode 1330 and the second electrode 1360 may include three projecting portions as illustrated in FIG. 13B. As above, the number of projecting portions may be changed variously.

Figure 13C:
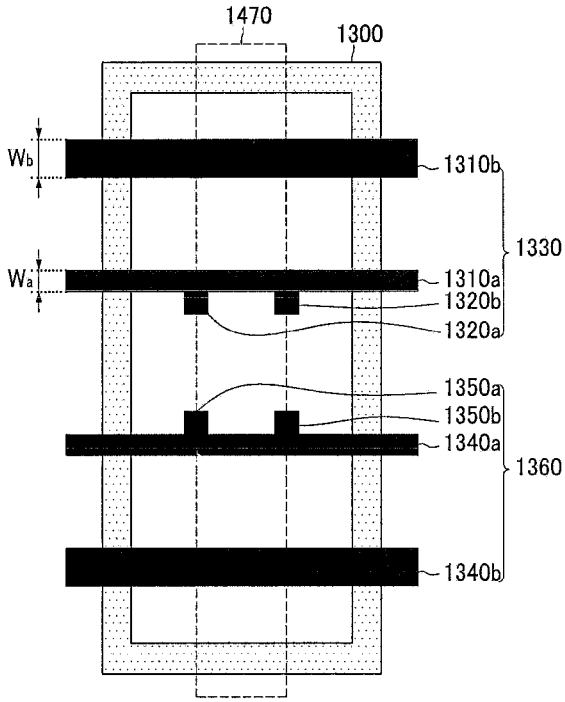

As illustrated in FIG. 13C, a width of at least one of the plurality of line portions 1310*a*, 1310*b*, 1340*a* and 1340*b* may be different from widths of the other line portions. For instance, a width Wa of the first line portion 1310*a* may be smaller than a width Wb of the second line portion 1310*b*.

Figure 13D:
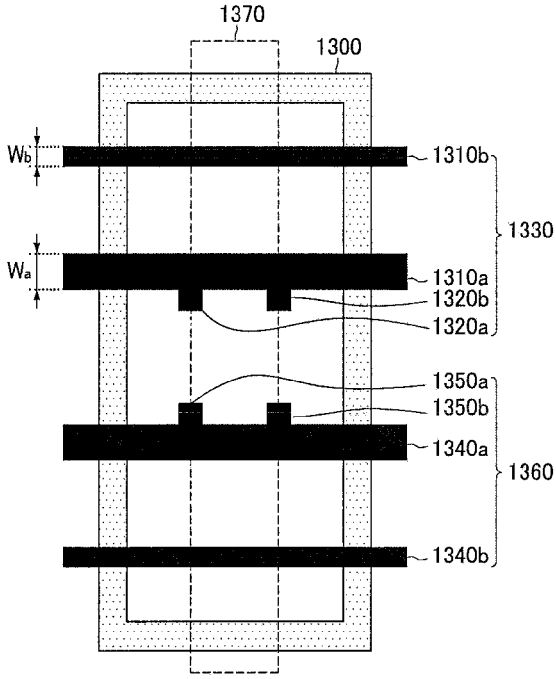

As illustrated in FIG. 13D, a width Wa of the first line portion 1310*a* may be larger than a width Wb of the second line portion 1310*b*.

Figure 14A:
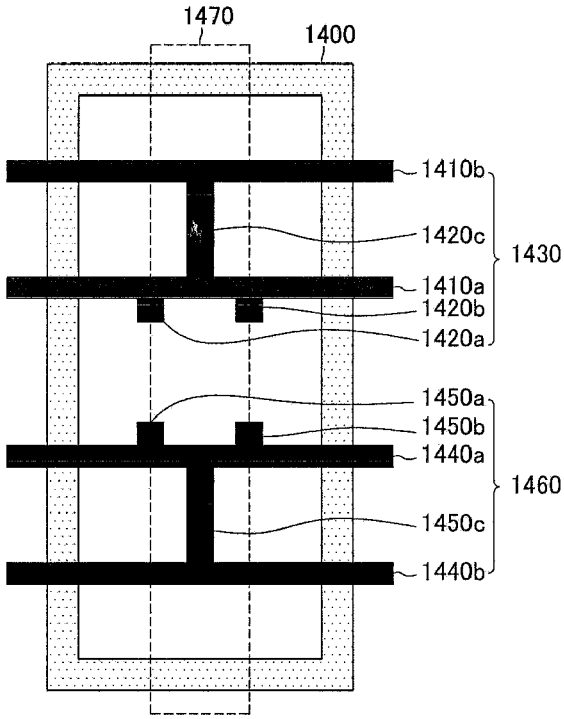
FIGS. 14A and 14B illustrate a second implementation associated with first and second electrodes in the plasma display panel of the plasma display apparatus according to the exemplary embodiment.
Figure 14B:
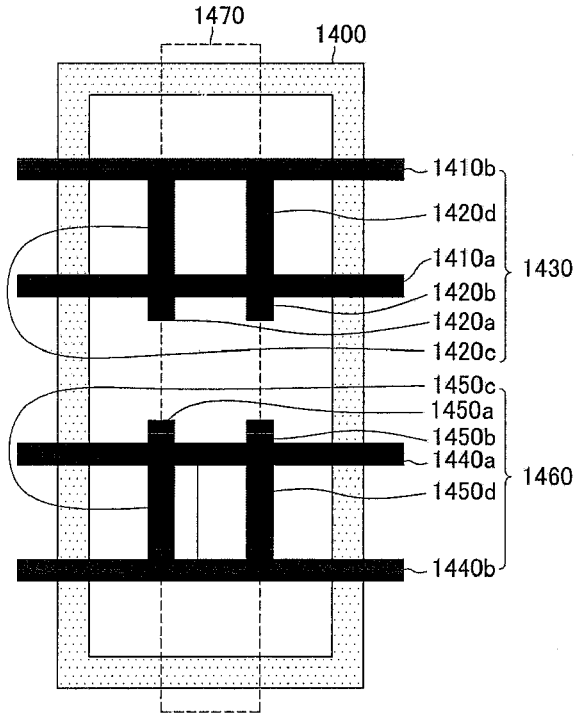

FIGS. 14A and 14B illustrate a second implementation associated with first and second electrodes in the plasma display panel of the plasma display apparatus according to the exemplary embodiment. The description of structures and components identical or equivalent to those illustrated and described in FIGS. 13A to 13D is briefly made or is entirely omitted in FIGS. 14A and 14B.

As illustrated in FIG. 14A, a connecting portion 1420*c* of a first electrode 1430 connects first and second line portions 1410*a* and 1410*b* of the first electrode 1430 to each other. A connecting portion 1450*c* of a second electrode 1460 connects first and second line portions 1440*a* and 1440*b* of the second electrode 1460 to each other. Hence, a discharge can be easily diffused inside a discharge cell partitioned by a barrier rib 1400.

While the first and second line portions 1410*a* and 1410*b* of the first electrode 1430 are connected using one connecting portion 1420*c* in FIG. 14A, the first and second line portions 1410*a* and 1410*b* of the first electrode 1430 may be connected using two connecting portions 1420*c* and 1420*d* as illustrated in FIG. 13B. As above, the number of connecting portions may be changed variously.

Figure 15A:
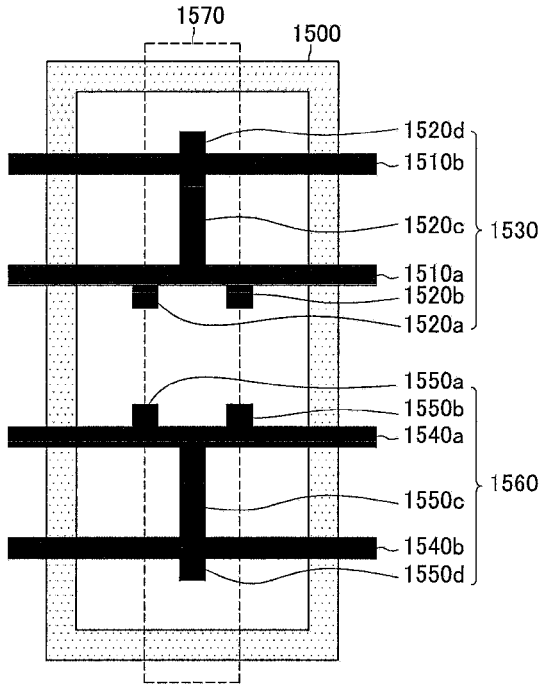
FIGS. 15A and 15B illustrate a third implementation associated with first and second electrodes in the plasma display panel of the plasma display apparatus according to the exemplary embodiment.
Figure 15B:
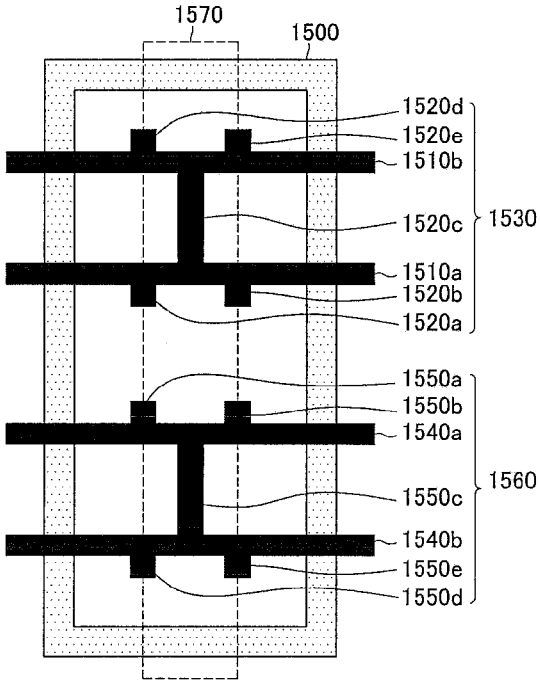

FIGS. 15A and 15B illustrate a third implementation associated with first and second electrodes in the plasma display panel of the plasma display apparatus according to the exemplary embodiment. The description of structures and components identical or equivalent to those illustrated and described in FIGS. 13A to 13D is briefly made or is entirely omitted in FIGS. 15A and 15B.

Referring to FIG. 15A, at least one of a plurality of projecting portions 1520*a*, 1520*b* and 1520*d* of a first electrode 1530 and at least one of a plurality of projecting portions 1550*a*, 1550*b* and 1550*d* of a second electrode 1560 may project toward a first direction. At least one of the plurality of projecting portions 1520*a*, 1520*b* and 1520*d* of the first electrode 1530 and at least one of the plurality of projecting portions 1550*a*, 1550*b* and 1550*d* of the second electrode 1560 may project toward a second direction different from the first direction.

The projecting portions 1520*a*, 1520*b*, 1550*a* and 1550*b* projecting toward the first direction is called a first projecting portion, and The projecting portions 1520*d* and 1550*d* projecting toward the second direction is called a second projecting portion. The first direction may be opposite to the second direction. For instance, the first direction may be a direction toward the center of a discharge cell, and the second direction may be a direction opposite the direction toward the center of the discharge cell.

The projecting portions 1520*c* and 1550*c*, that project toward the direction opposite the direction toward the center of the discharge cell, more widely diffuse a discharge generated inside the discharge cell.

While the first and second electrodes 1530 and 1560 each include only one second projecting portion projecting toward the second direction in FIG. 15A, each of the first and second electrodes 1530 and 1560 may include two second projecting portions 1520*d*, 1520*e*, 1550*d* and 1550*e* as illustrated in FIG. 15B. As above, the number of second projecting portions may be changed variously.

Figure 16A:
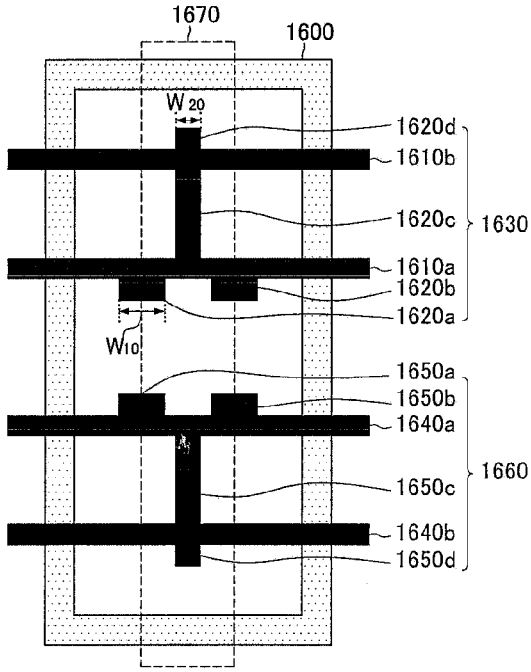
FIGS. 16A and 16B illustrate a fourth implementation associated with first and second electrodes in the plasma display panel of the plasma display apparatus according to the exemplary embodiment.
Figure 16B:
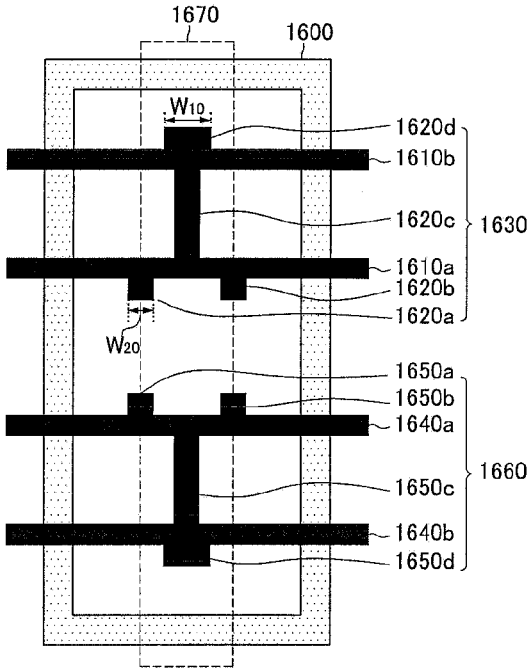

FIGS. 16A and 16B illustrate a fourth implementation associated with first and second electrodes in the plasma display panel of the plasma display apparatus according to the exemplary embodiment. The description of structures and components identical or equivalent to those illustrated and described in FIGS. 13A to 13D is briefly made or is entirely omitted in FIGS. 16A and 16B.

As illustrated in FIG. 16A, a shape of first projecting portions 1620*a*, 1620*b*, 1650*a* and 1650*b* projecting toward a first direction may be different from a shape of second projecting portions 1620*d* and 1650*d* projecting toward a second direction.

A width of the first projecting portions 1620*a*, 1620*b*, 1650*a* and 1650*b* is set to a tenth width W10, A width of the second projecting portions 1620*d* and 1650*d* is set to a twentieth width W20 smaller than the tenth width W10.

By setting the tenth width W10 of the first projecting portions 1620*a*, 1620*b*, 1650*a* and 1650*b* to be larger than the twentieth width W20 of the second projecting portions 1620*d* and 1650*d*, a firing voltage of a discharge generated between a first electrode 1630 and a second electrode 1660 can be lowered.

As illustrated in FIG. 16B, a width of the first projecting portions 1620*a*, 1620*b*, 1650*a* and 1650*b* is set to a twentieth width W20. A width of the second projecting portions 1620*d* and 1650*d* is set to a tenth width W10 larger than the twentieth width W20.

By setting the tenth width W10 of the second projecting portions 1620*d* and 1650*d* to be larger than the twentieth width W20 of the first projecting portions 1620*a*, 1620*b*, 1650*a* and 1650*b*, a discharge generated inside a discharge cell can be efficiently diffused into the rear of the discharge cell.

Figure 17A:
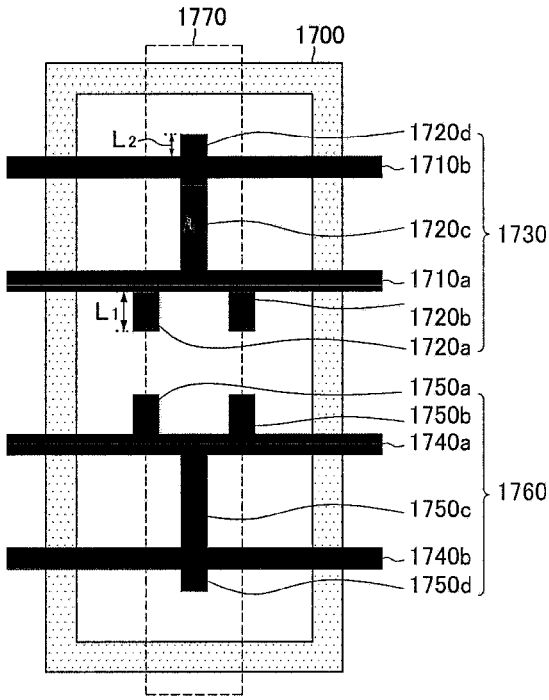
FIGS. 17A and 17B illustrate a fifth implementation associated with first and second electrodes in the plasma display panel of the plasma display apparatus according to the exemplary embodiment.
Figure 17B:
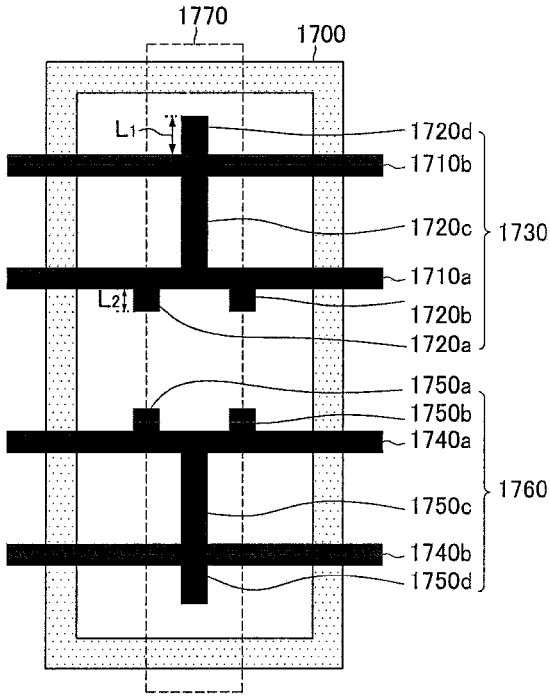

FIGS. 17A and 17B illustrate a fifth implementation associated with first and second electrodes in the plasma display panel of the plasma display apparatus according to the exemplary embodiment. The description of structures and components identical or equivalent to those illustrated and described in FIGS. 13A to 13D is briefly made or is entirely omitted in FIGS. 17A and 17B.

As illustrated in FIG. 17A, a length of first projecting portions 1720*a*, 1720*b*, 1750*a* and 1750*b* projecting toward a first direction may be different from a length of second projecting portions 1720*d* and 1750*d* projecting toward a second direction.

The length of the first projecting portions 1720*a*, 1720*b*, 1750*a* and 1750*b* is set to a first length L1. The length of the second projecting portions 1720*d* and 1750*d* is set to a second length L2 shorter than the first length L1.

By setting the first length L1 of the first projecting portions 1720*a*, 1720*b*, 1750*a* and 1750*b* to be longer than the second length L2 of the second projecting portions 1720*d* and 1750*d*, a firing voltage of a discharge generated between a first electrode 1730 and a second electrode 1760 can be lowered.

As illustrated in FIG. 17B, a length of the first projecting portions 1720*a*, 1720*b*, 1750*a* and 1750*b* is set to a second length L2. A length of the second projecting portions 1720*d* and 1750*d* is set to a first length L1 longer than the second length L2.

By setting the first length L1 of the second projecting portions 1720*d* and 1750*d* to be longer than the second length L2 of the first projecting portions 1720*a*, 1720*b*, 1750*a* and 1750*b*, a discharge generated inside a discharge cell can be efficiently diffused into the rear of the discharge cell.

Figure 18:
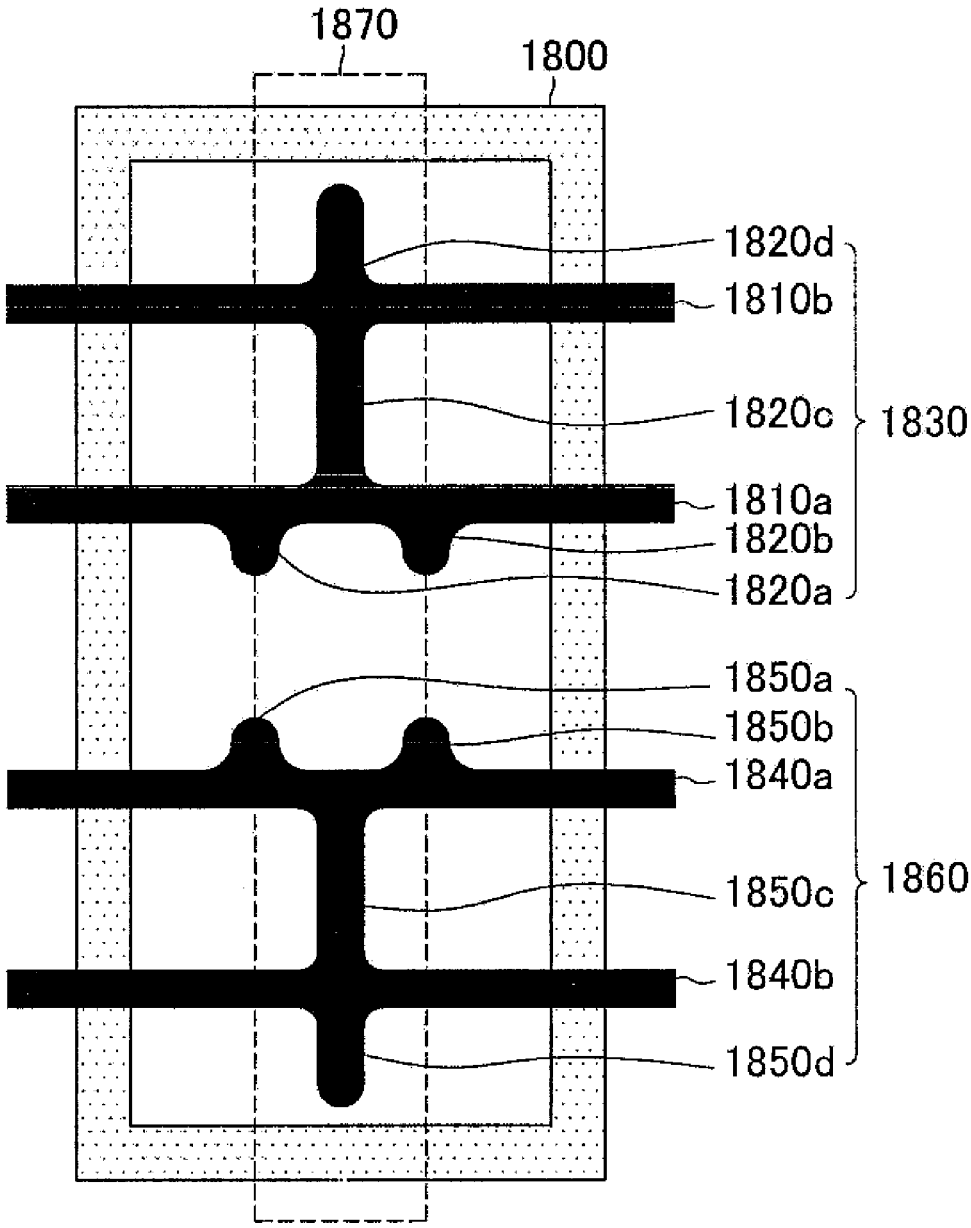
FIG. 18 illustrates a sixth implementation associated with first and second electrodes in the plasma display panel of the plasma display apparatus according to the exemplary embodiment.

FIG. 18 illustrates a sixth implementation associated with first and second electrodes in the plasma display panel of the plasma display apparatus according to the exemplary embodiment. The description of structures and components identical or equivalent to those illustrated and described in FIGS. 13A to 13D is briefly made or is entirely omitted in FIG. 18.

As illustrated in FIG. 18, at least one of projecting portions 1820*a*, 1820*b*, 1820*d*, 1850*a*, 1850*b* and 1850*d* may include a portion with the curvature. For instance, a tip portion of at least one of the projecting portions 1820*a*, 1820*b*, 1820*d*, 1850*a*, 1850*b* and 1850*d* may include the curvature. A portion where the projecting portions 1820*a*, 1820*b*, 1820*d*, 1850*a*, 1850*b* and 1850*d* are adjacent to line portions 1810*a*, 1810*b*, 1840*a* and 1840*b* may include the curvature.

Further, a portion where the line portions 1810*a*, 1810*b*, 1840*a* and 1840*b* are adjacent to connecting portions 1820*c* and 1850*c* may include the curvature.

As a result, the first electrode 1830 and the second electrode 1860 can be easily manufactured. Further, the portion with the curvature prevents wall charges from being excessively accumulated on a specific portion during a driving of the panel, and thus a driving stability can be improved.

Figure 19:
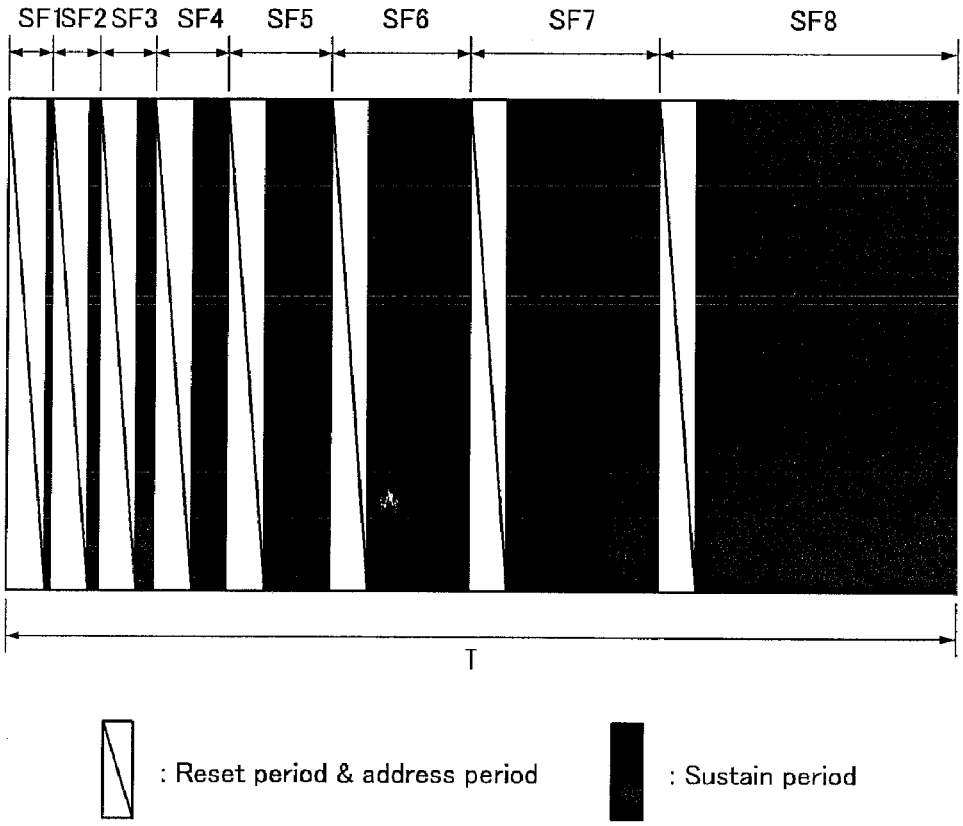
FIG. 19 illustrates a frame for achieving a gray scale of an image in the plasma display apparatus according to the exemplary embodiment.

FIG. 19 illustrates a frame for achieving a gray scale of an image in the plasma display apparatus according to the exemplary embodiment.

Figure 20:
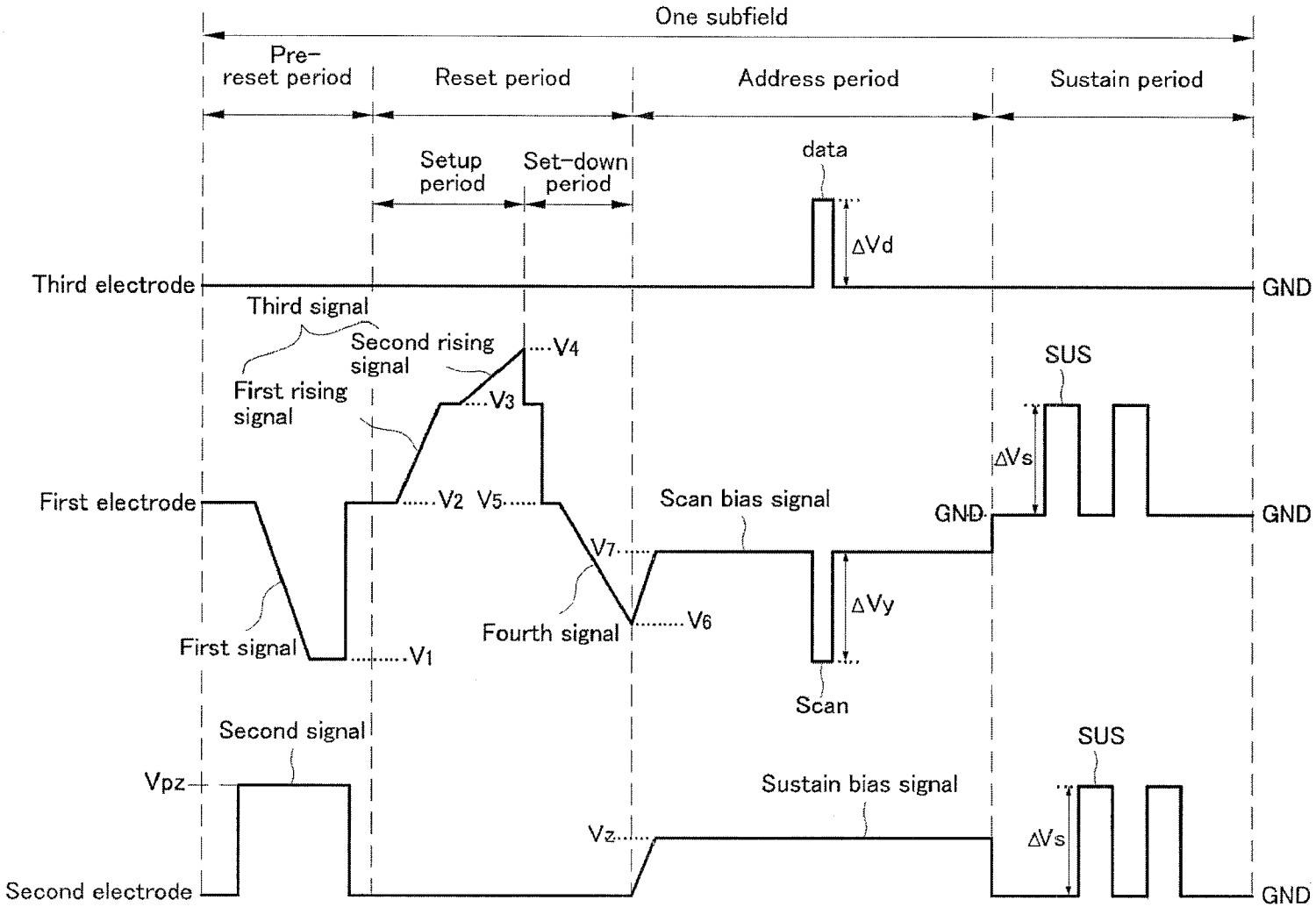
FIG. 20 illustrates an example of an operation of the plasma display apparatus according to the exemplary embodiment.

FIG. 20 illustrates an example of an operation of the plasma display apparatus according to the exemplary embodiment.

As illustrated in FIG. 19, a frame for achieving a gray scale of an image in he plasma display apparatus according to the exemplary embodiment is divided into several subfields each having a different number of emission times.

Each subfield is subdivided into a reset period for initializing all the cells, an address period for selecting cells to be discharged, and a sustain period for representing gray level in accordance with the number of discharges.

For instance, if an image with 256-level gray scale is to be displayed, a frame, as illustrated in FIG. 19, is divided into 8 subfields SF1 to SF8. Each of the 8 subfields SF1 to SF8 is subdivided into a reset period, an address period, and a sustain period.

The number of sustain signals supplied during the sustain period determines gray level weight in each of the subfields. For instance, in such a method of setting gray level weight of a first subfield to $2^0$ and gray level weight of a second subfield to $2^1$, the sustain period increases in a ratio of $2^n$ (where, n=0, 1, 2, 3, 4, 5, 6, 7) in each of the subfields. Since the sustain period varies from one subfield to the next subfield, a specific gray level is achieved by controlling the sustain period which are to be used for discharging each of the selected cells, i.e., the number of sustain discharges that are realized in each of the discharge cells.

The plasma display apparatus according to the exemplary embodiment uses a plurality of frames to display an image for 1 second. For instance, 60 frames are used to display an image 1 second. In this case, a time width T of one frame may be 1/60 seconds, i.e., 16.67 ms.

In FIG. 19, one frame includes 8 subfields. However, the number of subfields constituting one frame may vary. For instance, one frame may include 12 or 10 subfields.

Further, in FIG. 19, the subfields are arranged in increasing order of gray level weight. However, he subfields may be arranged in decreasing order of gray level weight, or the subfields may be arranged regardless of gray level weight.

FIG. 20 illustrates an example of an operation of the plasma display apparatus according to the exemplary embodiment in one subfield of a plurality of subfields of one frame as illustrated in FIG. 19.

During a pre-reset period prior to a reset period, a first signal with a gradually falling voltage is supplied to a first electrode Y. A second signal corresponding to the first signal is supplied to a second electrode Z. A polarity direction of the second signal is opposite to a polarity direction of the first signal. The second signal is constantly maintained at a voltage Vpz. The voltage Vpz may be substantially equal to a voltage (i.e., a sustain voltage Vs) of a sustain signal (SUS) to be supplied during a sustain period.

As above, when the first signal is supplied to the first electrode Y and the second signal is supplied to the second electrode Z during the pre-reset period, wall charges of a predetermined polarity are accumulated on the first electrode Y, and wall charges of a polarity opposite the polarity of the wall charges accumulated on the first electrode Y are accumulated on the second electrode Z. For instance, wall charges of a positive polarity are accumulated on the first electrode Y, and wall charges of a negative polarity are accumulated on the second electrode Z.

During a reset period, a third signal is supplied to the first electrode Y. The third signal includes a first rising signal and a second rising signal. The first rising signal gradually rises from a second voltage V2 to a third voltage V3 with a first slope, and the second rising signal gradually rises from the third voltage V3 to a fourth voltage V4 with a second slope.

The third signal generates a weak dark discharge (i.e., a setup discharge) inside the discharge cell during a setup period of the reset period, thereby accumulating a proper amount of wall charges inside the discharge cell.

The setup discharge does not occur at a voltage equal to or less than the third voltage V3, and the setup discharge can occur at a voltage equal to or more than the third voltage V3. Therefore, a voltage of the first electrode Y rapidly rises up to the third voltage V3 and then lowly rises. Hence, an excessive increase in a time width of the setup period can be prevented, and a stability of the setup discharge can be improved. Considering this, it is preferable that the second slope is gentler than the first slope.

Wall charges accumulated inside the discharge cells during the pre-reset period can assist the setup discharge generated during the setup period. Accordingly, although a voltage of the third signal is lowered, the stable setup discharge can occur. When the voltage of the third signal is lowered, the intensity of the setup discharge can be reduced and a reduction in the contrast characteristic can be prevented.

The operation of the plasma display apparatus during the pre-reset period can prevent a reduction in the contrast characteristic generated a case where the black layer is omitted between the upper dielectric layer and the front substrate as illustrated in FIGS. 10C and 11B.

A subfield, which is first arranged in time order in a plurality of subfields of one frame, may include a pre-reset period prior to a reset period so as to obtain sufficient driving time. Or, two or three subfields may include a pre-reset period prior to a reset period.

During a set-down period of the reset period, a fourth signal of a polarity direction opposite a polarity direction of the third signal is supplied to the first electrode Y. The fourth signal gradually falls from a fifth voltage V5 lower than a peak voltage (i.e., the fourth voltage V4) of the third signal to a sixth voltage V6. The fourth signal generates a weak erase discharge (i.e., a set-down discharge) inside the discharge cell. Furthermore, the remaining wall charges are uniform inside the discharge cells to the extent that an address discharge can be stably performed.

During an address period, a scan bias signal, which is maintained at a seventh voltage V7 higher than a lowest voltage (i.e., the sixth voltage V6) of the fourth signal, is supplied to the first electrode Y.

A scan signal (Scan), which falls from the scan bias signal by a scan voltage magnitude ΔVy, is supplied to the first electrode Y.

The width of the scan signal may vary from one subfield to the next subfield. For instance, the width of a scan signal in a subfield may be larger than the width of a scan signal in the next subfield in time order. Further, the width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, 1.9 μs, 1.9 μs, etc.

As above, when the scan signal (Scan) is supplied to the first electrode Y, a data signal (data) corresponding to the scan signal (Scan) is supplied to the third electrode X. The data signal (data) rises from a ground level voltage GND by a data voltage magnitude ΔVd.

As the voltage difference between the scan signal (Scan) and the data signal (data) is added to the wall voltage generated during the reset period, an address discharge is generated within the discharge cell to which the data signal (data) is supplied.

A sustain bias signal is supplied to the second electrode Z during the address period to prevent the generation of the unstable address discharge by interference of the second electrode Z. The sustain bias signal is substantially maintained at a sustain bias voltage Vz which is lower than the sustain voltage Vs and higher than the ground level voltage GND.

During the sustain period, a sustain signal (SUS) is alternately supplied to the first electrode Y and the second electrode Z. As the wall voltage within the discharge cell selected by performing the address discharge is added to the sustain voltage Vs of the sustain signal (SUS), every time the sustain signal (SUS) is supplied, a sustain discharge, i.e., a display discharge occurs between the first electrode Y and the second electrode Z. Accordingly, a predetermined image is displayed on the plasma display panel.

A plurality of sustain signals are supplied during a sustain period of at least one subfield, and a width of at least one of the plurality of sustain signals may be different from widths of the other sustain signals. For instance, a width of the first supplied sustain signal among the plurality of sustain signals may be larger than widths of the other sustain signals. Hence, a sustain discharge can more stably occur.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including:

a front substrate on which an upper dielectric layer is positioned, a black layer being omitted between the front substrate and the upper dielectric layer;

a first electrode and a second electrode positioned between the front substrate and the upper dielectric layer, wherein the first electrode and the second electrode contact the front substrate and the upper dielectric layer; and a rear substrate on which a third electrode is positioned to intersect the first electrode and the second electrode; and a filter positioned in front of the plasma display panel, the filter including:

a first portion having a first degree of blackness; and a second portion that is positioned on the first portion and has a second degree of blackness larger than the first degree of blackness, wherein an adhesive layer is positioned on a front surface of the plasma display panel, and the filter is attached to the adhesive layer, wherein the first portion and the second portion contact the adhesive layer, and wherein a height of the second portion is greater than a width of a base of the second portion, wherein the first electrode is a bus electrode and the second electrode is a bus electrode, wherein both the first electrode and the second electrode include at least one line portion intersecting the third electrode, and at least one projecting portion projecting from the line portion in a direction parallel to the third electrode, wherein the line portion of the first electrode includes a first scan line portion and a second scan line portion, wherein the line portion of the second electrode includes a first sustain line portion and a second sustain line portion, wherein a width of the first scan line portion is different from a width of the second scan line portion, and wherein a width of the first sustain line portion is different from a width of the second sustain line portion.

2. The plasma display panel of claim 1, wherein the projecting portion includes at least one first projecting portion projecting toward a first direction and at least one second projecting portion projecting toward a second direction opposite the first direction.

3. The plasma display panel of claim 2, wherein a length of the first projecting portion is different from a length of the second projecting portion, or a width of the first projecting portion is different from a width of the second projecting portion.

4. The plasma display panel of claim 1, wherein the number of line portions is plural, and at least one of the first electrode or the second electrode includes a connecting portion connecting two or more line portions of the plurality of line portions.

5. The plasma display panel of claim 1, wherein the projecting portion includes a portion with a curvature.

6. The plasma display panel of claim 1, wherein an angle formed by a traveling direction of the second portion and a longer side of the first portion ranges from 5° to 80°.

7. The plasma display panel of claim 1, wherein a refractive index of the second portion is smaller than a refractive index of the first portion.

8. The plasma display panel of claim 7, wherein the refractive index of the second portion ranges from 0.8 to 0.999 times the refractive index of the first portion.

9. A plasma display apparatus comprising:

a plasma display panel including:

a front substrate on which an upper dielectric layer is positioned;

a first electrode and a second electrode positioned between the front substrate and the upper dielectric layer, one surface of each of the first electrode and the second electrode contacting the front substrate, and the other surface of each of the first electrode and the second electrode contacting the upper dielectric layer; and a rear substrate on which a third electrode is positioned to intersect the first electrode and the second electrode; and a filter positioned in front of the plasma display panel, the filter including:

a first portion having a first degree of blackness; and a second portion that is positioned on the first portion and has a second degree of blackness larger than the first degree of blackness, wherein an adhesive layer is positioned on a front surface of the plasma display panel, and the filter is attached to the adhesive layer, wherein the first portion and the second portion contact the adhesive layer, and wherein a height of the second portion is greater than a width of a base of the second portion, wherein the first electrode is a bus electrode and the second electrode is a bus electrode, wherein both the first electrode and the second electrode include at least one line portion intersecting the third electrode, and at least one projecting portion projecting from the line portion in a direction parallel to the third electrode, wherein the line portion of the first electrode includes a first scan line portion and a second scan line portion, wherein the line portion of the second electrode includes a first sustain line portion and a second sustain line portion, wherein a width of the first scan line portion is different from a width of the second scan line portion, and wherein a width of the first sustain line portion is different from a width of the second sustain line portion.

10. The plasma display panel of claim 9, wherein a refractive index of the second portion is smaller than a refractive index of the first portion.

11. The plasma display panel of claim 9, wherein a refractive index of the second portion ranges from 0.8 to 0.999 times a refractive index of the first portion.

12. A plasma display apparatus comprising:

a plasma display panel including:

a front substrate on which an upper dielectric layer is positioned, a black layer being omitted between the front substrate and the upper dielectric layer;

a first electrode and a second electrode positioned between the front substrate and the upper dielectric layer; and a rear substrate on which a third electrode is positioned to intersect the first electrode and the second electrode; and a filter positioned in front of the plasma display panel, the filter including:

a first portion having a first degree of blackness; and a second portion that is positioned in the first portion and has a second degree of blackness larger than the first degree of blackness, wherein a first signal is supplied to the first electrode and a second signal of a polarity direction opposite a polarity direction of the first signal is supplied to the second electrode during a pre-reset period prior to a reset period of at least one subfield of a frame, wherein an adhesive layer is positioned on a front surface of the plasma display panel, and the filter is attached to the adhesive layer, wherein the first portion and the second portion contact the adhesive layer, and wherein a height of the second portion is greater than a width of a base of the second portion, wherein the first electrode is a bus electrode and the second electrode is a bus electrode, wherein both the first electrode and the second electrode include at least one line portion intersecting the third electrode, and at least one projecting portion projecting from the line portion in a direction parallel to the third electrode, wherein the line portion of the first electrode includes a first scan line portion and a second scan line portion, wherein the line portion of the second electrode includes a first sustain line portion and a second sustain line portion, wherein a width of the first scan line portion is different from a width of the second scan line portion, and wherein a width of the first sustain line portion is different from a width of the second sustain line portion.

13. The plasma display panel of claim 12, wherein a voltage of the first signal gradually falls over time.

14. The plasma display panel of claim 12, wherein a refractive index of the second portion ranges from 0.8 to 0.999 times a refractive index of the first portion.

15. The plasma display panel of claim 12, wherein a magnitude of a voltage of the second signal is substantially equal to a magnitude of a voltage of a sustain signal supplied to at least one of the first electrode or the second electrode during a sustain period after the reset period.

16. The plasma display panel of claim 12, wherein after the supply of the first signal, a third signal with a gradually rising voltage is supplied to the first electrode.

17. The plasma display panel of claim 16, wherein the third signal includes a first rising signal whose voltage gradually rises with a first slope and a second rising signal whose voltage gradually rises with a second slope.

18. The plasma display panel of claim 17, wherein the second slope is gentler than the first slope.

* * * * *